US007153625B2

(12) United States Patent
Kaburagi et al.

(10) Patent No.: US 7,153,625 B2
(45) Date of Patent: Dec. 26, 2006

(54) PROCESS FOR PRODUCING TONER PARTICLES, AND TONER

(75) Inventors: Takeshi Kaburagi, Numazu (JP); Yushi Mikuriya, Numazu (JP); Keiji Komoto, Numazu (JP); Yasushi Katsuta, Shizuoka-ken (JP); Kenichi Nakayama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 11/102,666

(22) Filed: Apr. 11, 2005

(65) Prior Publication Data

US 2005/0238984 A1 Oct. 27, 2005

Related U.S. Application Data

(63) Continuation of application No. PCT/JP2004/019663, filed on Dec. 21, 2004.

(30) Foreign Application Priority Data

Mar. 25, 2004 (JP) ..... 2004-088340

(51) Int. Cl.
*G03G 9/08* (2006.01)

(52) U.S. Cl. ..... 430/137.15; 430/137.17

(58) Field of Classification Search ..... 430/137.15, 430/137.16, 137.17; 523/305, 340
See application file for complete search history.

(56) References Cited

U.S. PATENT DOCUMENTS

| | | | | |
|---|---|---|---|---|
| 5,376,490 A | | 12/1994 | Sasaki et al. | 430/109 |
| 5,476,745 A | * | 12/1995 | Nakamura et al. | 430/137.17 |
| 6,387,581 B1 | * | 5/2002 | Moffat et al. | 430/137.14 |
| 2002/0042014 A1 | * | 4/2002 | Fujino et al. | 430/137.17 |

FOREIGN PATENT DOCUMENTS

| | | | |
|---|---|---|---|
| JP | 03246554 A | * | 11/1991 |
| JP | 05-197185 | | 8/1993 |
| JP | 07-049586 | | 2/1995 |
| JP | 09-179332 | | 7/1997 |
| JP | 10-312086 | | 11/1998 |
| JP | 11/160909 | | 6/1999 |
| JP | 2001/25569 | | 9/2001 |
| JP | 2002/08247 | | 3/2002 |

* cited by examiner

*Primary Examiner*—Christopher Rodee
(74) *Attorney, Agent, or Firm*—Fitzpatrick, Cella, Harper & Scino

(57) ABSTRACT

In a process for producing toner particles by dispersing in an aqueous medium a polymerizable monomer composition containing at least a polymerizable monomer and a colorant and carrying out polymerization by the use of a polymerization initiator, the concentration of alcohol having 4 to 6 carbon atoms in the aqueous medium is so adjusted as to be from 500 ppm to 2,000 ppm when the polymerization conversion of the polymerizable monomer composition is 30%, and to be from 2,300 ppm to 10,000 ppm when the polymerization conversion of the polymerizable monomer composition is 97%.

8 Claims, 6 Drawing Sheets

PROCESS FOR PRODUCING TONER PARTICLES, AND TONER

This application is a continuation of International Application No. PCT/JP2004/019663, filed on Dec. 21, 2004, which claims the benefit of Japanese Patent Application No. 2004-088340 filed on Mar. 25, 2004.

BACKGROUND OF THE INVENTION

1. Field of the Invention

This invention relates to a process for producing toner particles used in image forming methods in which electrostatic latent images are rendered visible, or in toner jet recording methods, and a toner having such toner particles.

2. Related Background Art

A number of methods are conventionally known as electrophotography. In general, copied images are obtained by forming an electrostatic latent image on an electrostatically charged image bearing member (hereinafter also "photosensitive member") by utilizing a photoconductive material and by various means, subsequently developing the latent image by the use of a toner to form a visible image (toner image), transferring the toner image to a transfer medium such as paper, and then fixing the toner image onto the transfer medium by the action of heat and/or pressure.

As for printers, LED printers or LBP printers are prevailing in the recent market, and are required to have higher resolution sop that the resolution has been raised from 240 or 300 dpi to 400, 600 or 800 dpi. With such resolution, higher definition has come to be required. Copying machines are developed to have advanced functions, resulting in progress toward digitalization. Since digitalization is primarily involved in a method in which electrostatic latent images are formed by using laser light, the progress also is directed to higher resolution, so that as with printers, developing methods are required to higher resolution and higher definition. As one means for satisfying this requirement, toner particle diameters have been progressively reduced, and a toner has been proposed having toner particles with small particle diameters in specific particle size distribution (see, e.g., Japanese Patent Application Laid-open No. H09-179332)

In recent years, there have been a tendency toward decreasing toner particle diameters in order to achieve higher resolution and higher definition, and the smaller the toner particle diameters, the more important the stable triboelectric charging of the toner. More specifically, unless each of the fine toner particles has been equally charged, image stability is apt to be remarkably lowered. The reason therefor is considered to be that toner particle diameters are simply reduced, and as compared with the coulomb force applied in a transfer step, the adhesive force of the toner to a photosensitive member (mirror image force or van der Waals force) comes to be too large, and as a result, residual toner increases, and besides, since reduction in toner particle diameters is accompanied by deterioration in flowablity, each toner is liable to be unevenly charged, toner particles causing fogging or inferior transfer increase.

In order to improve the performance of toner, it is essential for the toner to retain stabler charge characteristics. Factors to determine the charge characteristics of toner are roughly classified into the quantity of electric charges produced by friction between toner particles and the quantity of electric charges produced by friction or contact between toner particles and external members, where the charge characteristics of toner are greatly concerned with the surface material, and the size and shape of toner particles and the distribution states thereof, of each toner particle, and the influence of external additives aiming at auxiliary charging, control members making use of a metallic or rubber material, and charge control agents which are components included in toner particles.

For example, in the production of electrostatic latent image developing toners which produces toners by suspension polymerization, a method is proposed which enables particle shapes to be controlled and produces toner particles having small particle diameters and sharp particle size distribution, i.e, particle size distribution concentrated in a narrow range (see, e.g., Japanese Patent Application Laid-open No. H10-312086). This proposal is characterized in that a certain speed gradient and pH range are applied in machine agitation at the time of preparing an aqueous dispersion medium, and further, high-speed rotating shearing agitation having a certain speed gradient is carried out also at the time of granulating polymerizable monomers.

In respect of a method of preparing a sparingly water-soluble inorganic salt in an aqueous dispersion medium in suspension polymerization, it is proposed that pH is precisely controlled at the time of preparing the inorganic salt, the resulting suspension polymerization toner is reduced in its particle diameter, and particle size distribution is concentrated in a narrow range (see, e.g., Japanese Patent Application Laid-open No. H07-49586).

In all the above proposals, a certain effect can be obtained by concentrating the particle size distribution in a narrow range, but the effect is insufficient especially in respect of the control of fine particles having smaller particle diameters than the intended small-diameter toner particles. In the case where toner particles including such fine particles are used, even if the developing performance is satisfactory at the initial stage, it would be unsatisfactory in respect of transfer performance and anti-fogging properties, as continuous printing is repeatedly carried out in various environments. It is further disclosed that, in a method of producing toner particles by dispersing a polymerizable composition in an aqueous medium, an alcohol is added to the aqueous medium, (see, e.g., Japanese Patent Application Laid-open No. H05-197185). In such a proposal, however, the concentration of the alcohol is not controlled throughout polymerization reaction, and hence, even if the resulting toner has sufficient durability in a normal temperature and normal humidity environment, problems are apt to be raised in transfer performance and anti-fogging properties due to environmental variations. Thus, room is still left for improvement, and a toner is desired to satisfy the above requirements.

SUMMARY OF THE INVENTION

An object of the present invention is to provide a process for producing toner particles in which particle size distribution is concentrated in a narrow range, fine particles with particularly small particle diameters are controlled, and such fine particles is inhibited from being produced. Another object of the present invention is to provide a process for producing a toner which is superior in charging stability regardless of environmental variation and has good transfer performance and anti-fogging properties, and can generate highly detailed images, and also to provide a toner having toner particles produced by such a process for producing toner particles.

The present invention is directed to a process for producing toner particles which comprises dispersing in an aqueous medium a polymerizable monomer composition containing at least a polymerizable monomer and a colorant, and carrying out polymerization by the use of a polymerization initiator, wherein in the aqueous medium, alcohol having 4 to 6 carbon atoms is adjusted to be in a concentration of from 500 ppm to 2,000 ppm when the polymerization conversion of the polymerizable monomer is 30%, and to be in a concentration of from 2,300 ppm to 10,000 ppm when the polymerization conversion of the polymerizable monomer is 97%.

The present invention is also directed to a toner which comprises toner particles containing at least a binder resin and a colorant, wherein the toner particles are ones obtained by a process for producing toner particles which comprises dispersing in an aqueous medium a polymerizable monomer composition containing at least a polymerizable monomer and a colorant, and carrying out polymerization by the use of a polymerization initiator, wherein in the aqueous medium, alcohol having 4 to 6 carbon atoms is adjusted to be in a concentration of from 500 ppm to 2,000 ppm when the polymerization conversion of the polymerizable monomer is 30%, and to be in a concentration of from 2,300 ppm to 10,000 ppm when the polymerization conversion of the polymerizable monomer is 97%.

According to the present invention, a process for producing toner particles can be provided which have sharp particle size distribution and have been controlled especially in respect of fine particles having small particle diameter. Also, according to the present invention, a toner can be provided which is superior in charging stability regardless of environmental variation and has good transfer performance and anti-fogging properties, and can give highly detailed images.

DETAILED DESCRIPTION OF THE PREFERRED EMBODIMENTS

Figure 1:
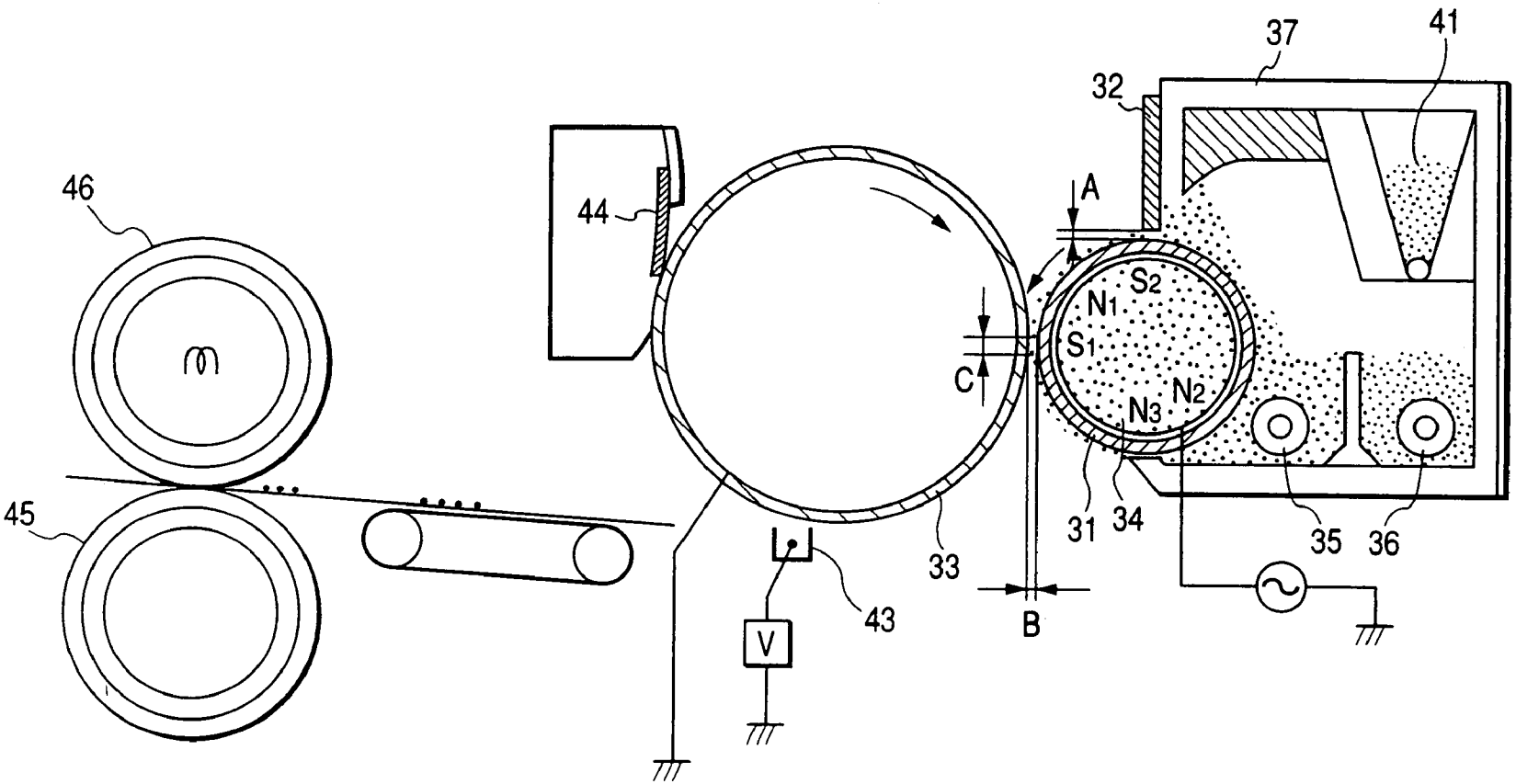
FIG. 1 is a schematic view showing an example of an image forming apparatus to which the toner of the present invention is applied.

In order to improve the performance of toner, the toner is inevitably required to increasingly retain stable charge characteristics. As stated above, the factors to determine the charge characteristics of toner are the quantity of electric charges produced by mutual friction of toner particles themselves and the quantity of electric charges produced by friction or contact of toner particles with external members. As a result of extensive studies, it has been found that the presence of fine particles having small particle diameter which come about especially when the toner particles are produced is particularly cited as a factor for toner particles to have non-uniform triboelectric charging performance, and that if the presence of such fine particles is controlled, the transfer performance and anti-fogging properties can be improved to heighten image quality.

Accordingly, in the production of toner particles by suspension polymerization, studies were done concerning production conditions and the quantity in which the fine particles having small particle diameter are generated. As a result, it was found that the generation quantity of the fine particles and the alcohol concentration in an aqueous medium have a close relationship with each other, and the generation can be controlled by regulating the alcohol concentration in an aqueous medium during the suspension polymerization.

Specifically, in a process for producing toner particles which comprises dispersing in an aqueous medium a polymerizable monomer composition containing at least a polymerizable monomer and a colorant, and carrying out polymerization by the use of a polymerization initiator, the toner particles are produced in such a way that in the aqueous medium, alcohol having 4 to 6 carbon atoms is adjusted to be in a concentration of from 500 ppm to 2,000 ppm when the polymerization conversion of the polymerizable monomer is 30%, and to be in a concentration of from 2,300 ppm to 10,000 ppm when the polymerization conversion of the polymerizable monomer is 97%.

Here, if the alcohol concentration of each of the polymerization conversions is not in the above range, the toner the generation of the fine particles with small particle diameters cannot be effectively controlled and the resulting toner particles are distributed over a wide range of sizes. The reason therefor have not been clearly resolved, but is considered to be due to the mutual action of a dispersion stabilizer which is present in the aqueous medium in suspension polymerization and stabilizes particles, viscosity according to the polymerization conversion of the polymerizable monomer, and alcohol present in the aqueous medium.

There is no specific limitation on how to control the alcohol concentration in the aqueous medium. Any control method may be applied such as directly adding alcohol, increasing the concentration relying on dissolution from toner particles, and removal from the aqueous medium by controlling temperature and pressure in the system.

In the present invention, any known alcohol having 4 to 6 carbon atoms may be used.

It is preferable that alcohol having 4 carbon atoms accounts for 90% by weight or more to 100% by weight or less of the alcohol components contained in the aqueous medium. If the alcohol is less than 90% by weight, the fine particles having small particle diameter tend to increase, and transfer performance and anti-fogging properties are liable to deteriorate. The reason therefor is considered to be that the mutual action stated above becomes stronger. Also, even with alcohol having 5 or 6 carbon atoms, the effects of the present invention is difficult to exhibit.

The alcohol having 4 carbon atoms is preferably tert-butyl alcohol.

In regard to polymerization reaction temperature, it is preferred in the process for producing toner particles according to the present invention that the polymerization reaction temperature is raised after the polymerization conversion of the polymerizable monomer reaches 30% and before reaching 97%. Further, it is more preferable that before the polymerization conversion of the polymerizable monomer reaches 30%, the polymerization is carried out at a temperature not higher than the azeotropic point of the aqueous medium and alcohol having 4 carbon atoms, and after the polymerization conversion of the polymerizable monomer reaches 30% or more and before reaching 97%, the polymerization is carried out at a temperature not lower than the azeotropic point of the aqueous medium and alcohol having 4 carbon atoms. This is considered to be due to the fact that the thermal motion condition of the alcohol and the dispersion stabilizer in the aqueous medium is optimized in respect to each viscosity according to the above polymerization conversion of the polymerizable monomer, and if the polymerization is carried out at a temperature outside the above range of the polymerization reaction temperature, the generation of the fine particles tends to increase.

The polymerization initiator used in the present invention has preferably a 10-hour half-life period temperature of from 40° C. or more to less than 60° C. If the 10-hour half-life period temperature is less than 40° C., it may be difficult to control the polymerization reaction, and coarse particles may increase so that the distribution of the toner particles will occur over a wide range of sizes. On the other hand, if the 10-hour half-life period temperature is more than 60° C., the polymerization reaction may slowly proceed, and monomers remaining for a long time may generate fine particles, and as a result, the distribution of the toner particles is liable to be over a wide range of sizes.

The polymerization initiator used in the present invention may include organoperoxides as exemplified by peroxy esters such as t-butyl peroxyacetate, t-butyl peroxylaurate, t-butyl peroxypivarate, t-butyl peroxy-2-ethyl hexanoate, t-butyl peroxyisobutyrate, t-butyl peroxyneodecanoate, t-hexyl peroxyacetate, t-hexyl peroxylaurate, t-hexyl peroxypivarate, t-hexyl peroxy-2-ethyl hexanoate, t-hexyl peroxyisobutyrate, t-hexyl peroxyneodecanoate, t-butyl peroxybenzoate, α,α'-bis(neodecanoylperoxy)diisopropylbenzene, cumyl peroxyneodicanoate, 1,1,3,3-tetramethylbutyl peroxy-2-ethylhexanoate, 1,1,3,3-tetramethylbutyl peroxyneodicanoate, 1-cyclohexyl-1-methyethyl peroxyneodicanoate, 2,5-dimethyethyl-2,5-bis(2-ethylhexanoylperoxy) hexane, 1-cyclohexyl-1-methylethyl peroxy-2-ethylhexanoate, t-hexyl peroxyisopropyl monocarbonate, t-butyl peroxyisopropyl monocarbonate, t-butyl peroxy-2-hexyl monocarbonate, t-hexyl peroxybonzoate, 2,5-dimethyethyl-2,5-bis(benzoylperoxy)hexane, t-butyl peroxy-m-toluoyl benzoate, bis(t-butylperoxy)isophthalate, t-butyl peroxymaleic acid, t-butyl peroxy-3,5,5-trimethyl hexanoate, 2,5-dimethylethyl-2,5-bis(m-toluoylperoxy)hexane, t-amyl peroxyneodecanoate, t-amyl peroxypivarate, t-amyl 2-ethylhexanoate, t-amyl peroxynormaloctoate, t-amyl peroxyacetate, t-amyl peroxyisononanoate, and t-amyl peroxybenzoate; diacyl peroxides such as benzoyl peroxide, lauroyl peroxide, isobutyryl peroxide and succinic peroxide; and peroxydicarbonates such as diisopropyl peroxydicarbonate, di-2-ethoxyethyl peroxydicarbonate, di-2-ethylhexyl peroxydicarbonate, and di-sec-butylperoxy peroxydicarbonate. Of these, what are suitable for the present invention are peroxy esters.

Among the foregoing polymerization initiators, use of the compound represented by the following formula (1) which enables the effects of the present invention to be sufficiently exhibited is preferred:

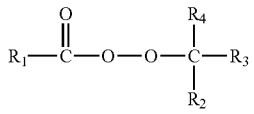

(1)

Wherein $R_1$ is a functional group selected from the group consisting of a substituted or unsubstituted alkyl group having 3 to 8 carbon atoms, a substituted or unsubstituted cycloalkyl group having 3 to 8 carbon atoms and a substituted or unsubstituted aryl group having 3 to 8 carbon atoms. Also, $R_2$, $R_3$ and $R_4$ are each independently a substituted or unsubstituted alkyl group, provided that a total number of carbon atoms of $R_2$, $R_3$ and $R_4$ is 3 to 5.

Such peroxy esters as represented by the above formula (1) are preferable because they are effective especially in controlling residual monomers, and inhibit fine particles from being generated at the terminal stage.

If the number of carbon atoms in $R_1$ is 2 or less, the polarity is strong, and the polymerization reaction may take place in an aqueous phase, and there is a tendency for fine particles to increase. If the number of carbon atoms is 9 or more, it may be difficult to control polymerization reaction.

In addition, it is preferable that the total number of carbon atoms in $R_2$, $R_3$ and $R_4$ is 3 to 5. If the total number of carbon atoms is 6 or more, the polymerization reaction is liable to be difficult to control, and it may be difficult to control coarse particles from being generated.

If necessary, two or more types of those peroxides may be used, and the following azo-type polymerization initiators may be used alone or in combination with the above peroxides: 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile, and azobisisobutyronitrile.

Where the polymerization initiator used in the present invention may be added in an amount of from 0.5 to 20 parts by weight based on 100 parts by weight of the polymerizable monomer to carry out the polymerization reaction, a polymer can be obtained having the maximum in molecular weight distribution between 10,000 and 100,000, thus providing strength suitable for toner and desirable melting properties.

As for the polymerizable monomers included in the polymerizable monomer composition in the production of the toner particles of the present invention, the the following may be cited: styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other polymerizable monomers such as acrylonitrile, methacrylonitrile and acrylamides. Any of these monomers may be used alone or in combination.

A cross-linking agent may also optionally be used in the present invention. As the cross-linking agent used in the present invention, compounds having two or more polymerizable double bonds are primarily used, and may include aromatic divinyl compounds as exemplified by divinylbenzene and divinylnaphthalene; carboxlates having two double bonds as exemplified by ethylene glycol diacrylate, ethylene glycol dimethacrylate, 1,3-butanediol dimethacrylate and 1,3-butanediol dimethacrylate; divinyl compounds such as divinylaniline, divinyl ether, divinyl sulfide and divinyl sulfone; and compounds having three or more vinyl groups. Any of these cross-linking agents may be used alone or in combination. It is preferable to use the cross-linking agent in an amount of from 0.01 to 1.0 part by weight based on 100 parts by weight of the polymerizable monomer, while the amount needs to be adjusted depending on the types of polymerization initiators, the types of cross-linking agents and reaction conditions.

In order to further effectively exhibit the effects of the present invention, it is preferable that at least one of substituted or unsubstituted styrenes and at least one of (meth) acrylates are contained as essential components in the polymerizable monomer composition. If none of the substituted or unsubstituted styrenes and the (meth)acrylates are contained, the uniform dispersibility of charge control agents and wax in toner particles may be impaired, and the charging stability of the toner tends to deteriorate.

In regard to the colorant used in the present invention, carbon black, magnetic materials, and colorants whose color has been adjusted to black by the use of yellow, magenta and cyan colorants as shown below may be used as black colorants. When choosing colorants, attention should be paid to polymerization inhibitory action and aqueous-phase migration properties inherent in the colorants. Preferably, it is better for the colorant to be subjected to surface modification (e.g., hydrophobic treatment free of any polymerization inhibition).

As the yellow colorant, compounds typified by condensation azo compounds, isoindolinone compounds, anthraquinone compounds, azo metal complexes, methine compounds and allylamide compounds may be used. Stated specifically, C.I. Pigment Yellow 12, 13, 14, 15, 17, 62, 74, 83, 93, 94, 95, 109, 110, 111, 128, 129, 147, 168 and 180 are preferably used.

As the magenta colorant, condensation azo compounds, diketopyrrolopyrrole compounds, anthraquinone compounds, quinacridone compounds, basic dye lake compounds, naphthol compounds, benzimidazolone compounds, thioindigo compounds and perylene compounds may be used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221 and 254 are particularly preferable.

As the cyan colorant used in the present invention, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be used alone or in combination, or in the state of a solid solution. The colorants used in the present invention are selected taking account of hue angle, chroma, brightness, weatherability, transparency on OHP films and dispersibility in toner particles. The colorant may preferably be added in an an amount of from 1 to 20 parts by weight based on 100 parts by weight of the binder resin.

The toner of the present invention may also be further incorporated with a magnetic material so that it can be used as a magnetic toner. In this case, the magnetic material may also serve as a colorant. The magnetic material incorporated in the magnetic toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures thereof.

The magnetic material used in the present invention may preferably be a surface-modified magnetic material, and, when used in a polymerization toner, may more preferably be one subjected to hydrophobic treatment with a surface modifier having no polymerization inhibitory action. Such a surface modifier may include, e.g., silane coupling agents and titanium coupling agents.

These magnetic materials may preferably be those having an average particle diameter of 2.0 μm or less, and preferably from about 0.1 to 0.5 μm. The quantity incorporated in the toner particles may be preferably from 20 to 200 parts by weight, and more preferably from 40 to 150 parts by weight, based on 100 parts by weight of the binder resin.

In the production of the toner of the present invention, the polymerization may be carried out by adding the resin in a polymerizable monomer composition. For example, a polymerizable monomer component containing a hydrophilic functional group such as an amino group, a carboxylic acid group, a hydroxyl group, a sulfonic acid group, a glycidyl group or a nitrile group can not be used as it is because it is water-soluble and dissolves in an aqueous suspension to cause emulsion polymerization. Accordingly, when such a monomer component is intended to be introduced into toner particles, it may be used in the form of a copolymer such as a random copolymer, a block copolymer or a graft copolymer, with a vinyl compound such as styrene or ethylene, in the form of a polycondensation product such as polyester or polyamide, or in the form of a polyaddition product such as polyether or polyimine. Where the high polymer containing such a polar functional group (hereinafter "polar polymer") is allowed to coexist in the toner particles, the wax component described previously can be phase-separated, and can more firmly be enclosed in particles, so that a toner having good anti-blocking properties and developing performance can be obtained.

Of these resins, especially the incorporation of a polyester resin can be greatly effective. This is presumed to be for the following reason: The polyester resin contains many ester linkages, which are functional groups having a relatively high polarity, and hence the resin itself has a high polarity. On account of this polarity, a tendency for the polyester to be localized at droplet surfaces is strongly exhibited in the aqueous dispersion medium, and the polymerization proceeds in that state until toner particles are formed. Hence, the polyester resin is localized at toner particle surfaces to establish a uniform surface state and surface composition. As a result, very good developing performance can be achieved in virtue of a synergistic effect of uniform charging performance and the fact that the wax (release agent) is enclosed in a good state.

In addition, a polymer having a molecular weight different from the molecular weight range of the toner particles to be obtained by polymerizing the polymerizable monomer may be dissolved in the monomer to carry out polymerization, where a toner can be obtained having a broad molecular weight distribution and high anti-offset properties.

In the present invention, in order to achieve good charging performance involved with superior transfer performance and anti-fogging properties, it is preferable to make the toner spherical in particle shape. Stated specifically, the toner may preferably have an average circularity of from 0.960 to 1.000, and more preferably from 0.970 to 1.000. If the toner has an average circularity of from 0.960 to 1.000, the contact area between the toner particles and the photosensitive member can be reduced to decrease the adhesive force of toner particles to a photosensitive member which is ascribable to mirror image force or van der Waals force, and the toner can be easily transferred. In addition, since the circularity is high enough for the toner particles to have a shape close to spheres, the whole particle surfaces can readily uniformly be brought into friction, and hence the toner can have superior charge uniformity, as compared with an amorphous toner having uneven particle surfaces.

In the circularity distribution of the toner, the toner may more preferably have a mode circularity of from 0.99 to 1.00. When the mode circularity is from 0.99 to 1.00, it means that most of toner particles have a shape close to true spheres, where the above effect becomes more remarkable, and triboelectric charging performance and transfer performance are further improved. Here, the "mode circularity" refers to the lower-limit value of a division range in which the frequency value comes to the maximum in the circularity frequency distribution obtained in such a way that circularities of from 0.40 to 1.00 are divided into 61 ranges at intervals of 0.01 and the toner circularities measured are allotted to the respective division ranges in accordance with the circularities.

Here, if the toner has an average circularity of less than 0.960, it may be difficult to achieve the charge uniformity of the toner, resulting in increase in fog or density non-uniformity in some cases.

Studies have been made also on conditions under which minuter latent image dots can be faithfully developed. As a result, the effect of improving image characteristics has been found to be remarkable when the toner has a weight-average particle diameter of from 3 μm to 10 μm. If the toner has a weight-average particle diameter of less than 3 μm, low transfer efficiency may result, and besides fog may increase because individual toner particles are difficult to uniformly charge. If on the other hand the toner has a weight-average particle diameter of more than 10 μm, spots around line images tend to appear on character or line images, and high resolution cannot be achieved in some cases.

In order to faithfully reproduce much minuter latent image dots by the use of the toner obtained by the present invention, the toner may also preferably have a weight-average particle diameter of from 4 μm to 8 μm.

The release agent usable in the toner of the present invention may include petroleum wax such as paraffin wax, microcrystalline wax and petrolatum, and derivatives thereof; montan wax and derivatives thereof; hydrocarbon wax obtained by Fischer-Tropsch synthesis, and derivatives thereof; polyolefin waxes such as polyethylene wax, and derivatives thereof; and naturally occurring wax such as carnauba wax and candelilla wax, and derivatives thereof. The derivatives include oxides, block copolymers with vinyl monomers, and graft modified products. Also usable are higher aliphatic alcohols, fatty acids such as stearic acid and palmitic acid, or compounds thereof, acid amide wax, ester wax, ketones, hardened caster oil and derivatives thereof, vegetable wax, animal wax, silicone oils and so forth.

Of these, ester waxes are particularly preferred from the viewpoint of superior releasability. Specifically, ester waxes of the following formulas (IV) to (VIII) are preferable:

(IV)

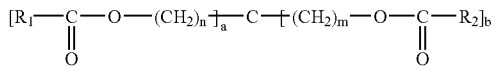

wherein a and b are each independently an integer of 0 to 4, provided that a+b is 4; $R_1$ and $R_2$ are each independently an organic group having 1 to 40 carbon atoms; and m and n are each independently an integer of 0 to 40, provided that m and n are not 0 at the same time.

(V)

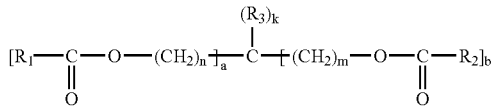

wherein a and b are each independently an integer of 0 to 3, provided that a+b is 1 to 3; $R_1$ and $R_2$ are each independently an organic group having 1 to 40 carbon atoms; $R_3$ is a hydrogen atom or an organic group having 1 or more carbon atoms; k is an integer of 1 to 3 and a+b+k=4; and m and n are each independently an integer of 0 to 40, provided that m and n are not 0 at the same time.

(VI)

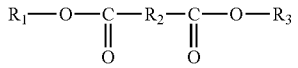

wherein $R_1$ and $R_3$ are each independently an organic group having 1 to 40 carbon atoms; and $R_2$ represents an organic group having 1 to 40 carbon atoms.

(VII)

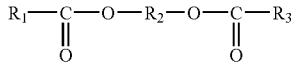

wherein $R_1$ and $R_3$ are each independently an organic group having 1 to 40 carbon atoms; and $R_2$ represents an organic group having 1 to 40 carbon atoms.

(VIII)

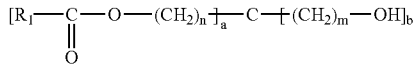

wherein a is an integer of 0 to 4 and b is an integer of 1 to 4, provided that a+b is 4; $R_1$ is an organic group having 1 to 40 carbon atoms; and m and n are each independently an integer of 0 to 40, provided that m and n are not 0 at the same time.

Then, the release agent may preferably be in a content of from 1 to 30% by weight, and more preferably from 3 to 25% by weight, based on the weight of the binder resin. If the release agent is in a content of less than 1% by weight, the effect exhibited by the addition of the release agent may be insufficient, and further the effect of inhibiting offset may also be insufficient. If on the other hand it is in a content of more than 30% by weight, the toner may be inferior in long-term storage stability, and also the dispersibility of toner materials such as colorants may become inferior, tending to cause deterioration in coloring power of the toner or a lowering of image characteristics. Bleeding of the release agent is apt to occur, resulting in deterioration in running performance in a high-temperature and high-humidity environment. Further, since the release agent is enclosed in toner particles in a large quantity, the shape of toner particles is liable to be distorted.

Of these release agent components, one is preferred having a maximum endothermic peak in the region of from 45 to 90° C. at the time of heating, in the DSC curve measured with a differential scanning calorimeter. Inasmuch as the release agent has a maximum endothermic peak in the above temperature region, it greatly contributes to low-temperature fixing and at the same time exhibits its releasability effectively. If the maximum endothermic peak is less than 45° C., the release agent component may be weak in self-cohesive force, resulting in deterioration in high-temperature anti-offset properties. Also, the bleeding of the release agent tends to occur, and the toner may have a low charge quantity. If on the other hand the maximum endothermic peak is more than 90° C., fixing temperature may be so high as to cause low-temperature offset, which is undesirable. Further, in the case where the toner particles are directly obtained by a polymerization process in which granulation and polymerization are carried out in an aqueous medium, a problem may arise such that the release agent component precipitates primarily during granulation if the maximum endothermic peak temperature is high, resulting in poor dispersibility of the release agent, which is undesirable.

The maximum endothermic peak temperature of the wax component is measured according to ASTM D3418-8. For example, DSC-7, manufactured by Perkin-Elmer Corporation, is used for the measurement. The temperature at the detecting portion of the device is corrected on the basis of melting points of indium and zinc, and the amount of heat is corrected on the basis melting heat of indium. In the measurement, the sample is put in a pan made of aluminum and an empty pan is set for control, carrying out measurement at a heating rate of 10° C./min.

The toner of the present invention may be mixed with a charge control agent in order to stabilize charge characteristics. As the charge control agent, any known charge control agent may be used. In particular, charge control agents that have a high charging speed and also can stably maintain a constant charge quantity are preferred. Further, in the case where the toner particles are directly produced by polymerization, charge control agents are particularly preferred which are low in polymerization inhibitory action and substantially free of materials soluble into the aqueous dispersion medium. Specific compounds may include, as negative charge control agents, metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; polymer type compounds having a sulfonic acid or carboxylic acid group in their side chains; and boron compounds, urea compounds, silicon compounds and carixarene; as positive charge control agents, quaternary ammonium salts, polymer type compounds having such a quaternary ammonium salt in their side chains, guanidine compounds, Nigrosine compounds and imidazole compounds.

As methods for incorporating the toner with the charge control agent, internal or external addition to the toner particles are available. The quantity of the charge control agent to be used depends on types of binder resins, the presence of other additives, and the production process of the toner, inclusive of the dispersing way, and can not absolutely be specified. When added internally, the charge control agent may be used in an amount ranging from 0.1 to 10 parts by weight, and more preferably from 0.1 to 5 parts by weight, based on 100 parts by weight of the binder resin. When added externally, the charge control agent may preferably be added in an amount of from 0.05 to 1.0 part by weight, and more preferably from 0.01 to 0.3 part by weight, based on 100 parts by weight of the toner.

In the polymerization process for producing the toner of the present invention, toner-composing materials such as the above colorant, a magnetic powder and the release agent are commonly appropriately added to the polymerizable monomer, and dissolved or dispersed by means of a dispersion machine such as a homogenizer, a ball mill, a colloid mill or an ultrasonic dispersion machine to prepare a polymerizable monomer composition. This composition is suspended in an aqueous medium containing a dispersion stabilizer. Here, a high-speed stirrer or a high-speed dispersion machine such as an ultrasonic dispersion machine may be used to allow the toner particles to have the desired particle size at once, so that the resulting toner particles can be distributed in a narrow range of sizes. The polymerization initiator may be added at the same time other additives are added to the polymerizable monomer, or may be mixed immediately before the polymerizable monomer composition is suspended in the aqueous medium. Also, the polymerization initiator may be added during granulation or immediately after granulation.

After the granulation, agitation may be carried out using a usual agitator in such an extent that the state of particles is maintained and also the particles can be prevented from floating and settling.

In the case where the polymerization toner of the present invention is produced, any known surface-active agent or organic or inorganic dispersant may be used as the dispersion stabilizer. In particular, the inorganic dispersant may hardly cause any harmful ultrafine powder, and may attain dispersion stability on account of its steric hindrance. Hence, even when reaction temperature is changed, the inorganic dispersant may hardly loose its stability, can be easily washed, and hardly affect the toner. Thus, the inorganic dispersant may preferably be used. Examples of such an inorganic dispersant may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

When these inorganic dispersants are used, they may be used as they are. In order to obtain finer particles, particles of the inorganic dispersant may be formed in the aqueous medium when used. For example, in the case of tricalcium phosphate, an aqueous sodium phosphate solution and an aqueous calcium chloride solution may be mixed under high-speed agitation, whereby water-insoluble calcium phosphate can be formed and more uniform and finer dispersion can be prepared. Here, water-soluble sodium chloride is simultaneously formed as a by-product. However, the presence of such a water-soluble salt in the aqueous medium keeps the polymerizable monomer from being dissolved in water, so that it is difficult for ultrafine toner particles to be produced by emulsion polymerization, which is more favorable. The inorganic dispersant can substantially completely be removed by dissolving it with an acid or an alkali after the polymerization has been completed.

Any of these inorganic dispersants may be used in an amount of from 0.2 to 20 parts by weight based on 100 parts by weight of the polymerizable monomer, alone or in combination with a surface-active agent used in an amount of from 0.001 to 0.1 part by weight.

Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

The polymerization toner particles obtained by polymerization may be subjected to filtration, washing and drying by conventional methods, and an inorganic fine powder may optionally be mixed so as to adhere to particle surfaces. Thus, the toner of the present invention can be obtained. Also, a classification step may be added to production steps to cut coarse powder and fine powder. This is also one of preferred embodiments of the present invention.

In the present invention, an inorganic fine powder having a number-average primary particle diameter of from 4 nm to 100 nm may be added to the toner as a fluidity improver. This is also a preferred embodiment. The inorganic fine powder is added in order to improve the fluidity of the toner and to uniformly charge the toner particles, where the inorganic fine powder may be subjected to treatment such as hydrophobic treatment so that the toner can be endowed with functions of regulating its charge quantity and improving its environmental stability.

If the inorganic fine powder has a number-average primary particle diameter of more than 100 nm or the inorganic fine powder of 100 nm or less in diameter is not added, the good fluidity of the toner cannot be achieved, so that the toner particles are apt to be unevenly charged to cause fogging, decrease in image density and toner scatter. If the inorganic fine powder has a number-average primary particle diameter of less than 4 nm, the inorganic fine powder is strongly liable to agglomerate, and tends to behave not as primary particles but as agglomerates having broad particle size distribution which are so strongly agglomerative as to be difficult to break up even by disintegration treatment, so that the agglomerates may be involved in development or scratch the image bearing member or toner carrying member to cause image defects. In order to make the toner have more uniform charge distribution, it is better for the inorganic fine powder to have a number-average primary particle diameter of from 6 nm to 70 nm.

In the present invention, the number-average primary particle diameter of the inorganic fine powder may be measured in the following way: On a photograph of toner particles taken under magnification on a scanning electron microscope, while making a comparison with a photograph of toner particles mapped with elements included in the inorganic fine powder, by an elemental analysis means such as XMA (X-ray micro-analyzer) attached to the scanning electron microscope, at least 100 primary particles of the inorganic fine powder in the state of adhesion to or liberation from toner particle surfaces are measured to determine the number-based average primary particle diameter (also called number-average primary particle diameter).

It is preferable that the toner of the present invention is comprised of the toner particles and the inorganic fine powder. As the inorganic fine powder, it is preferable to use at least one selected from silica, titanium oxide and alumina. The inorganic fine powder may be used alone or in a combination of two or more types. As the silica, usable are, e.g., what is called dry-process silica or fumed silica produced by vapor phase oxidation of silicon halides and what is called wet-process silica produced from water glass or the like. The dry-process silica is preferred, as having less silanol groups on the particle surfaces and interiors of the fine silica powder and leaving less production residues such as $Na_2O$ and $SO_3^{2-}$. In the production step for the dry-process silica, it is also possible to use, e.g., other metal halide such as aluminum chloride or titanium chloride together with the silicon halide to give a composite fine powder of silica with other metal oxides. The dry-process silica includes these as well.

The inorganic fine powder having a number-average primary particle diameter of from 4 nm to 100 nm may preferably be added in an amount of from 0.1 to 3.0% by weight based on the weight of the toner particles. When added in an amount of less than 0.1% by weight, the effect brought about by the addition of the inorganic fine powder may be difficult to obtain. When added in an amount of more than 3.0% by weight, the toner may have poor fixing performance. In addition, the content of the inorganic fine powder may be determined by fluorescent X-ray analysis and using a calibration curve prepared from a standard sample.

In the present invention, taking into account properties in a high-temperature and high-humidity environment, the inorganic fine powder may preferably be one subjected to hydrophobic treatment. Where the inorganic fine powder added to the toner has moistened, the toner particles may be charged in a very low quantity to tend to cause toner scatter.

As a treating agent used for such hydrophobic treatment, usable are silicone varnish, various types of modified silicon varnish, silicone oil, various types of modified silicone oil, silane compound, a silane coupling agent, other organosilicon compounds and organotitanium compounds. Any of these treating agents may be used alone or in combination.

In particular, those having been treated with silicone oil are preferred. Those obtained by subjecting the inorganic fine powder to hydrophobic treatment with silane compound and, simultaneously with or after the treatment, treatment with silicone oil are more preferred in order to maintain the charge quantity of the toner particles at a high level even in a high humidity environment and to prevent toner scatter.

In a method for such treatment of the inorganic fine powder, for example the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be one having a viscosity at 25° C. of from 10 to 200,000 $mm^2/s$, and more preferably from 3,000 to 80,000 $mm^2/s$. If the viscosity is less than 10 $mm^2/s$ the inorganic fine powder may have no stability, and the image quality tends to lower because of thermal and mechanical stress. If the viscosity is more than 200,000 $mm^2/s$, it tends to be difficult to carry out uniform treatment.

As the silicone oil to be used, particularly preferred are, e.g., dimethylsilicone oil, methylphenylsilicone oil, α-methylstyrene modified silicone oil, chlorophenylsilicone oil and fluorine modified silicone oil.

Methods for treating the inorganic fine powder with the silicone oil include, for example, a method in which the inorganic fine powder treated with a silane compound and the silicone oil is directly mixed by means of a mixer such as a Henschel mixer, and a method in which the silicone oil is sprayed on the inorganic fine powder. Alternatively, a method may be used in which the silicone oil is dissolved or dispersed in a suitable solvent and thereafter the inorganic fine powder is added thereto and mixed, followed by removal of the solvent. In view of such an advantage that the generation of agglomerates of the inorganic fine powder is less, the method making use of a sprayer is preferred.

The silicone oil may be used for the treatment in an amount of from 1 to 40 parts by weight, and preferably from 3 to 35 parts by weight, based on 100 parts by weight of the inorganic fine powder. If the silicone oil is in a too small quantity, the inorganic fine powder can not be made well hydrophobic. If it is in a too large quantity, problems such as fogging are apt to occur.

The inorganic fine powder used in the present invention may preferably be at least one inorganic fine powder selected from silica, titanium oxide and alumina. Of these, silica is particularly preferred. It may further preferably be one having a specific surface area ranging from 20 to 350 $m^2/g$, and more preferably from 25 to 300 $m^2/g$, as measured by the BET method utilizing nitrogen absorption.

The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

In order to improve cleaning performance and so forth, inorganic or organic fine particles close to a sphere having a primary particle diameter of more than 30 nm (preferably having a BET specific surface area of less than 50 $m^2/g$), and more preferably a primary particle diameter of 50 nm or more (preferably having a BET specific surface area of less than 30 $m^2/g$), may further be added to the toner of the present invention. This is also one of preferred embodiments. For example, spherical silica particles, spherical polymethylsilsesquioxane particles and spherical resin particles may preferably be used.

In the toner of the present invention, other additives may further be used as long as their addition substantially does not adversely affect the toner, which may include, e.g., lubricant powder such as polyethylene fluoride powder, zinc stearate powder and polyvinylidene fluoride powder; or abrasives such as cerium oxide powder, silicon carbide powder and strontium titanate powder; and reverse-polarity organic fine particles and inorganic fine particles which may also be used in a small quantity as a developability improver. These additives may also be used after hydrophobic treatment of the particle surfaces.

A method of externally adding the above fine powder to the toner may be carried out by mixing and agitating the toner particles and the fine powder, specifically including methods making use of Mechanofusion, I-type mill, Hybridizer, Turbo mill, a Henschel mixer and so forth. From the viewpoint of preventing coarse particles from being generated, it is particularly preferable to use a Henschel mixer.

The toner of the present invention may be used as a toner of a non-magnetic one-component developer, or may also be used as a toner for a two-component developer having carrier particles. Where it is used as a non-magnetic toner, a method is available in which using a blade or a roller, the toner is forcibly triboelectrically charged by the aid of a developing sleeve to cause the toner to adhere onto the sleeve, and is conveyed.

Where the toner is used as the two-component developer, a carrier is used together with the toner of the present invention so as to be used as a developer. A magnetic carrier may be constituted solely of an element selected from the group consisting of iron, copper, zinc, nickel, cobalt, manganese and chromium element, or in the state of a composite ferrite carrier. The shape of magnetic-carrier particles may be spherical, flat or shapeless. It is also preferable to control the microstructure of magnetic carrier particle surfaces (e.g., surface unevenness). In general, an inorganic oxide of the foregoing is burned and granulated to beforehand produce magnetic carrier core particles, which are coated with a resin. For the purpose of lessening the load of magnetic carrier to toner, it is also possible to use a method in which the inorganic oxide and the resin are kneaded, followed by pulverization and classification to produce in a low-density dispersed carrier, or a method in which a kneaded product of the inorganic oxide and monomers is directly subjected to suspension polymerization in an aqueous medium to produce a true-spherical magnetic carrier.

A coated carrier obtained by coating the surfaces of the above carrier particle with a resin is particularly preferred. As methods used therefor, there are a method in which a resin dissolved or suspended in a solvent is coated to adhere to carrier particles, and a method in which a resin powder and the carrier particles are merely mixed with carrier particles to adhere thereto.

The material to be allowed to adhere to the carrier particle surfaces may differ depending on toner materials, and include, for example, polytetrafluoroethylene, monochlorotrifluoroethylene polymer, polyvinylidene fluoride, silicone resins, polyester resins, styrene resins, acrylic resins, polyamide, polyvinyl butyral, and aminoacrylate resins. Any of these may be used alone or in a combination of two or more types.

The carrier may be one having the following magnetic characteristics: The magnetization intensity ($\sigma_{79.6}$) under application of 79.57 kA/m (1,000 oersteds) after having been magnetically saturated is required to be from 3.77 to 37.7 $\mu Wb/cm^3$. In order to achieve a higher image quality, it may preferably be from 12.6 to 31.4 $\mu Wb/cm^3$. If it is more than 37.7 $\mu Wb/cm^3$, it may be difficult to obtain toner images having a high image quality. If it is less than 3.77 $\mu Wb/cm^3$, the carrier may also have less magnetic binding force to tend to cause carrier adhesion.

In the case where the toner of the present invention is blended with the magnetic carrier to prepare a two-component developer, they may be blended in such a ratio that the toner in the developer is in a concentration of from 2 to 15% by weight, and preferably from 4 to 13% by weight, whereby good results can usually be obtained.

Examples of image-forming methods to which the toner of the present invention is applicable are described below with reference to the drawings.

The toner of the present invention may be blended with the magnetic carrier, and may perform development using such a developing means 37 as shown in FIG. 1. Stated specifically, development may preferably be performed applying an alternating electric field and in such a state that a magnetic brush comes into touch with an electrostatic image bearing member (e.g., photosensitive drum) 33. A distance B between a developer carrying member (developing sleeve) 31 and the photosensitive drum 33 (S-D distance) may preferably be from 100 μm to 1,000 μn. This is favorable for preventing carrier adhesion and improving dot reproducibility. If it is smaller than 100 μm, the developer tends to be insufficiently fed, resulting in a low image density. If it is larger than 1,000 μm, the magnetic lines from a magnetic pole S1 may broaden so that the magnetic brush have a low density, resulting in poor dot reproducibility, or the force of binding the carrier weakens, tending to cause carrier adhesion. A toner 41 is successively fed to the developing assembly and is blended with the carrier by agitation means 35 and 36. The toner and carrier thus blended are conveyed to the developing sleeve 31 holding a stationary magnet 34 internally.

The alternating electric field may preferably be applied at a peak-to-peak voltage of from 500 V to 5,000 V and a frequency of from 500 Hz to 10,000 Hz, and preferably from 500 Hz to 3,000 Hz, which may each be applied under appropriate selection in conformity with the process. In this case, the waveform may be used while being variously selected from a triangular waveform, a rectangular waveform, a sinusoidal waveform, or a waveform varied in a duty ratio. If the applied voltage is lower than 500 V, a sufficient image density may be difficult to attain, and fog toner at non-image areas can not be sufficiently collected in some cases. If it is higher than 5,000 V, the electrostatic latent image may be disrupted through the magnetic brush to cause a lowering of image quality.

Use of a two-component developer having a toner suitably charged enables a low fog take-off voltage (Vback) to be applied, and enables the primary charging of the photosensitive member to be lowered, thus the photosensitive member can be allowed to have a longer lifetime. The Vback may preferably be 150 V or below, and more preferably 100 V or below, depending on the developing system.

As contrast potential, a potential of from 200 V to 500 V may preferably be used so that a sufficient image density can be achieved.

If the frequency is lower than 500 Hz, electric charges may be injected into the carrier while concerned with the process speed, so that carrier adhesion may occur or latent images may be disrupted to cause a lowering of image quality. If it is higher than 10,000 Hz, the toner can not follow the electric field to tend to cause a lowering of image quality.

In order to perform development which ensures a sufficient image density, achieves a superior dot reproducibility and is free of carrier adhesion, the magnetic brush on the developing sleeve 31 may preferably be brought into touch with the photosensitive drum 33 at a width (developing nip C) of from 3 mm to 8 mm. If the developing nip C is narrower than 3 mm, it may be difficult to establish sufficient image density and dot reproducibility. If it is broader than 8 mm, the developer may pack into the nip to cause the machine to stop from operating, or it may be difficult to sufficiently prevent the carrier adhesion. As for methods for adjusting the developing nip, the nip width may appropriately be adjusted by adjusting the distance A between a developer control blade 32 and the developing sleeve 31, or by adjusting the distance B between the developing sleeve 31 and the photosensitive drum 33.

In the reproduction of full-color images which attaches importance especially to halftones, three or more developing assemblies for magenta, cyan and yellow may be used, and the developer and developing method of the present invention may be used, especially in combination with a development system in which digital latent images are formed. Thus, the latent images are not affected by the magnetic brush and are not disrupted, and hence can be developed faithfully to the dot latent images. Also in the transfer step, using the toner of the present invention, high transfer efficiency can be achieved, and therefore a high image quality can be realized in both halftone areas and solid areas.

In addition, concurrently with achievement of a high image quality at the initial stage, using the toner of the present invention, image quality is not lowered even in many-sheet copying, and the effect of the present invention can be exhibited.

The toner image held on the latent image bearing member 33 is transferred onto a transfer medium by a transfer means 43 such as a corona charging assembly. The toner image thus held on the transfer medium is fixed by a heat-and-pressure fixing means having a heating roller 46 and a pressure roller 45. Transfer residual toner remaining on the electrostatic image bearing member 33 is removed from the electrostatic image bearing member 33 by a cleaning means 44 such as a cleaning blade.

In order to obtain good full-color images, developing assemblies for magenta, cyan, yellow and black which are so disposed that development for black is finally performed, whereby images with clear edges can be obtained.

An example of an image forming apparatus which can preferably carry out a multi-color or full-color image formation process is described below with reference to FIG. 2.

Figure 2:
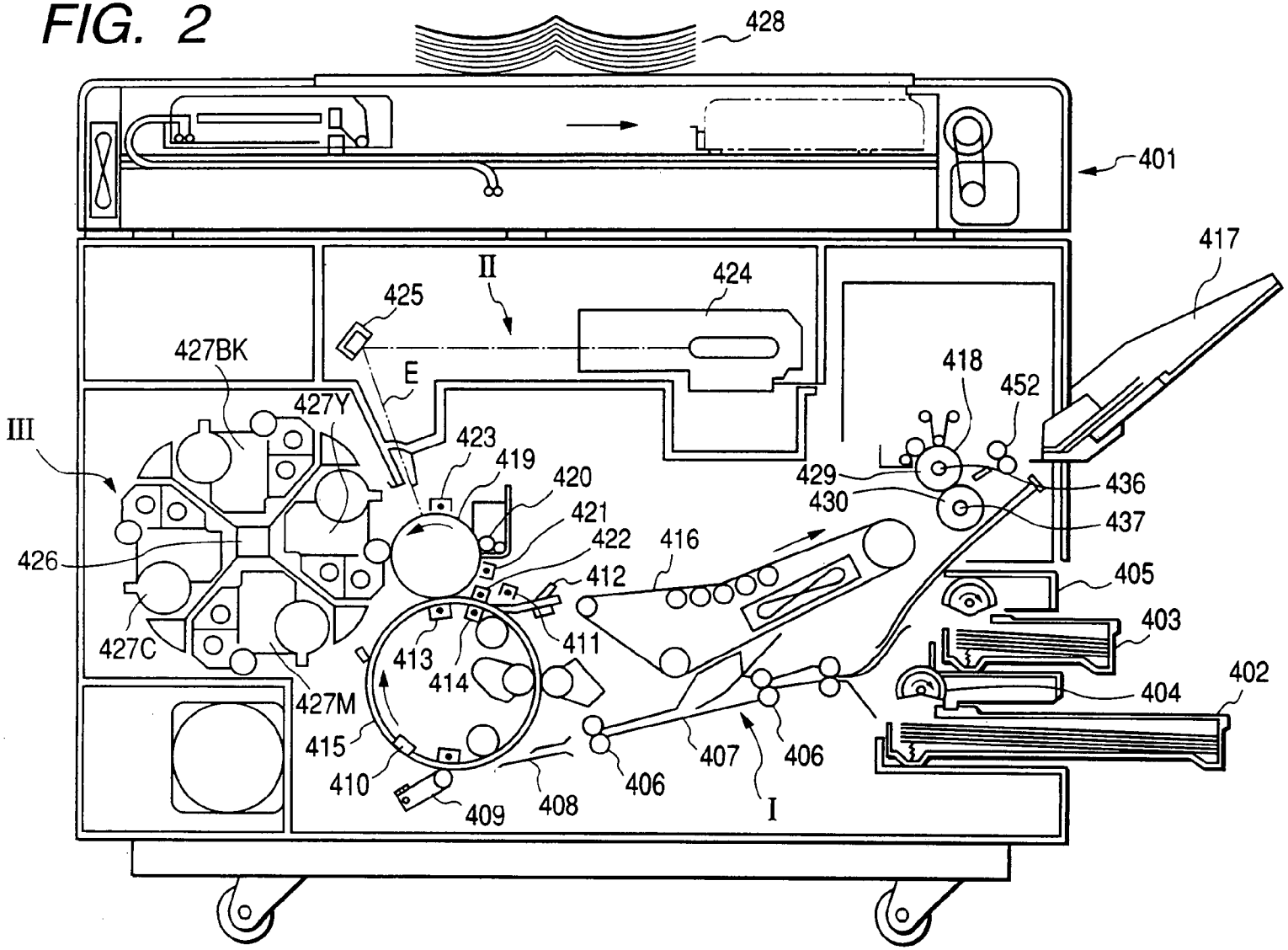
FIG. 2 is a schematic view showing an example of a full-color or multi-color image forming apparatus.

A multi-color or full-color image forming apparatus illustrated in FIG. 2 is roughly grouped into a transfer medium transport system I which is so provided as to extend from the right side of the main body of the apparatus substantially to the middle of the main body of the apparatus, a latent image forming zone II provided substantially in the middle of the main body of the apparatus and in proximity to a transfer drum 415 constituting the transfer medium transport system I, and a developing means (i.e., a rotary developing unit) III provided in proximity to the latent image forming zone II.

The above transfer medium transport system I is constructed in the following way. It has openings which are formed in the right wall (on the right side as viewed in FIG. 2) of the main body of the apparatus, and transfer medium feeding trays 402 and 403 detachable through the openings are so provided that they partly extend toward the outside of the apparatus. Paper feed rollers 404 and 405 are provided almost directly above the trays 402 and 403, respectively, and a paper feed roller 406 and paper guides 407 and 408 are so provided that the paper feed rollers 404 and 405 can be associated with the transfer drum 405, which is provided on the left side and rotated in the direction of an arrow A. A contacting roller 409, a gripper 410, a transfer medium separating corona assembly 411 and a separating claw 412 are sequentially provided in the vicinity of the periphery of the transfer drum 415 from the upstream side to the downstream side in the direction of its rotation.

A transfer corona assembly 413 and a transfer medium separating corona assembly 414 are provided inside the periphery of the transfer drum 415. A transfer sheet (not shown) formed of a polymer such as polyvinylidene fluoride is stuck to the part where the transfer medium on the transfer drum 415 is wound, and the transfer medium is electrostatically brought into close contact with the surface of the transfer sheet. A transport belt means 416 is provided in proximity to the separating claw 412 at the right upper part of the transfer drum 415, and a fixing assembly 418 is provided at the terminal (on the right side) of the transfer medium transport direction of the transport belt means 416. A paper output tray 417 extending to the outside of the main body 401 of the apparatus and detachable from the main body 401 of the apparatus is provided more downstream in the transport direction than the fixing assembly 418.

The latent image forming zone II is constructed as described below. A latent image bearing member photosensitive drum (e.g. an OPC photosensitive drum) 419 rotated in the direction of an arrow shown in FIG. 2 is so provided that its periphery comes into contact with the periphery of the transfer drum 415. Above the photosensitive drum 419 and in the vicinity of the periphery thereof, a charge eliminating corona assembly 420, a cleaning means 421 and a primary corona assembly 423 are sequentially provided from the upstream side to the downstream side in the direction of rotation of the photosensitive drum 419. An imagewise exposure means 424 such as a laser beam scanner to form an electrostatic latent image on the periphery of the photosensitive drum 419, and an imagewise exposing light reflecting means 425 such as a mirror are also provided.

The rotary developing unit III is constructed in the following way. A rotatable housing (hereinafter "rotator") 426 is set at the position facing the periphery of the photosensitive drum 419. In the rotator 426, four kinds of developing assemblies are mounted at four positions in the peripheral direction and are so constructed that electrostatic latent images formed on the periphery of the photosensitive drum 419 can be made into visible images (i.e., developed). The four kinds of developing assemblies comprise a yellow developing assembly 427Y, a magenta developing assembly 427M, a cyan developing assembly 427C and a black developing assembly 427BK, respectively.

The sequence of the whole image forming apparatus constructed as described above is described by giving an example of full-color mode image formation. With the rotation of the above photosensitive drum 419 in the direction of the arrow in FIG. 2, the photosensitive drum 419 is electrostatically charged by means of the primary corona assembly 423. In the apparatus shown in FIG. 2, the photosensitive drum 419 is operated at a peripheral speed (hereinafter "process speed") of 100 mm/sec or higher (e.g., 130 to 250 mm/sec). Upon electrostatic charging on the photosensitive drum 419 by means of the primary corona assembly 423, imagewise exposure is effected using laser light E modulated by yellow image signals of an original 428, so that an electrostatic latent image is formed on the photosensitive drum 419, and then the electrostatic latent image is developed by means of the yellow developing assembly 427Y previously set at a developing position by the rotation of the rotator 426. Thus, a yellow toner image is formed.

The transfer medium transported through the paper feed guide 407, paper feed roller 406 and paper feed guide 408 is fastened by the gripper 410 at a given timing, and is electrostatically wound around the transfer drum 415 by means of the contacting roller 409 and an electrode set opposite the contacting roller 409. The transfer drum 415 is rotated in the direction of the arrow in FIG. 2 while synchronized with the photosensitive drum 419. The yellow toner image formed by the yellow developing assembly 427Y is transferred onto the transfer medium by means of the transfer corona assembly 413 at the portion where the periphery of the photosensitive drum 419 and the periphery of the transfer drum 415 come into contact with each other. The transfer drum 415 is continuously rotated without stopping, and stands ready for a next color (magenta as viewed in FIG. 2).

The photosensitive drum 419 is de-charged by means of the charge eliminating corona assembly 420, and is cleaned through the cleaning means 421 by a cleaning blade. Thereafter, it is again electrostatically charged by means of the primary corona assembly 423, and is subjected to imagewise exposure according to the next magenta image signals, where an electrostatic latent image is formed. The above rotary developing unit is rotated while the electrostatic latent image is formed on the photosensitive drum 419 according to the magenta image signals as a result of the imagewise exposure, until the magenta developing assembly 427M is set at the above developing position, where the development is performed using a stated magenta toner. Subsequently, the process as described above is also carried out on a cyan color and a black color each. After transfer steps corresponding to the four colors have been completed, four-color visible images formed on the transfer medium are de-charged by the corona assemblies 422 and 414, and the transfer medium fastened by the gripper 410 is released therefrom. At the same time, the transfer medium is separated from the transfer drum 415 by means of the separating claw 412, and then delivered to the fixing assembly 418 over the delivery belt 416, where the images are fixed by the action of heat and pressure. Thus, the sequence of full-color print is completed and the desired full-color print image is formed on one side of the transfer medium.

Another image forming method is specifically described below with reference to FIG. 3.

Figure 3:
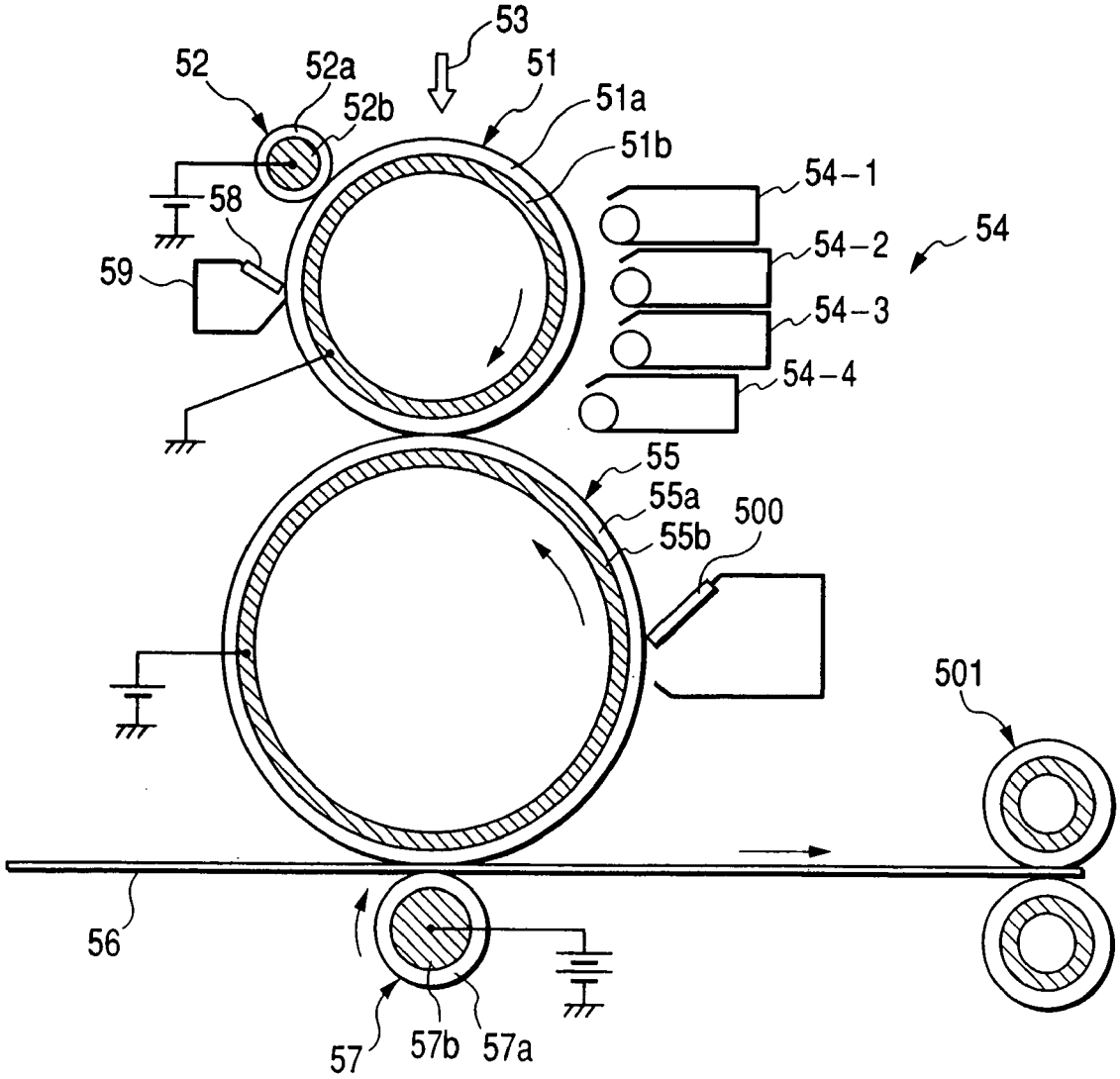
FIG. 3 is a schematic view showing an example of an image forming apparatus having an intermediate transfer member.

In an image forming apparatus shown in FIG. 3, a developer having a cyan toner, a developer having a magenta toner, a developer having a yellow toner and a developer having a black toner are put into developing assemblies 54-1, 54-2, 54-3 and 54-4, respectively. Electrostatic latent images formed on a photosensitive member 51 are developed by a magnetic-brush developing system or a non-magnetic one-component developing system to form toner images of respective colors on the photosensitive member 51. The photosensitive member 51 is a photosensitive drum or photosensitive belt having a photoconductive insulating material layer formed of a-Se, CdS, $ZnO_2$, OPC or a-Si. The photosensitive member 51 is rotated by means of a drive system (not shown) in the direction of an arrow.

As the photosensitive member 51, a photosensitive member having an amorphous silicon photosensitive layer or an organic photosensitive layer may preferably be used.

The organic photosensitive layer may be of a single-layer type in which the photosensitive layer contains a charge generating material and a charge transporting material in the same layer, or may be a function-separated photosensitive layer constituted of a charge transport layer and a charge generation layer. A multi-layer type photosensitive layer having a structure in which the charge generation layer and the charge transport layer in this order are superposed on a conductive substrate is one of preferred examples.

As binder resins for the organic photosensitive layer, polycarbonate resins, polyester resins or acrylic resins may be used, where especially good transfer performance and cleaning performance are established, and faulty cleaning, melt-adhesion of toner to the photosensitive member and filming of external additives are hardly caused.

In the step of charging, a system using a corona charging assembly and being in non-contact with the photosensitive member 51 or a contact type system using a roller can be utilized. The contact type system as shown in FIG. 3 may preferably be used so as to realize efficient and uniform charging, to simplify the system and to reduce ozone.

A charging roller 52 is constituted basically of a mandrel 52*b* at the center and a conductive elastic layer 52*a* that forms the periphery of the former. The charging roller 52 is brought into pressure contact with the surface of the photosensitive member 51 and is rotated following the rotation of the photosensitive member.

Process conditions preferable when the charging roller is used are as follows: a roller contact pressure of 4.9 to 490 N/m (5 to 500 g/cm), and an AC voltage of 0.5 to 5 kVpp, an AC frequency of 50 Hz to 5 kHz and a DC voltage of ±0.2 to ±1.5 kV when a voltage generated by superimposing an AC voltage on a DC voltage; and a DC voltage of from ±0.2 to ±5 kV when a DC voltage is used.

For a charging means other than the charging roller, a charging blade or a conductive brush is available. These contact charging means have an effect of, e.g., making high voltage unnecessary and reducing ozone.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride).

The toner image on the photosensitive member 51 is transferred to an intermediate transfer member 55 to which a voltage (e.g., ±0.1 to ±5 kV) is kept applied. The surface of the photosensitive member 51 after transfer is cleaned by a cleaning means 59 having a cleaning blade 58.

The intermediate transfer member 55 is constituted of a pipe-like conductive mandrel 55*b* and a medium-resistance elastic material layer 55*a* formed thereon. The mandrel 55*b* may be formed of a plastic pipe provided thereon with a conductive coating.

The medium-resistance elastic material layer 55*a* is a solid or foamed-material layer made of an elastic material such as silicone rubber, fluorine resin rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance value (volume resistivity) to a medium resistance of from $10^5$ to $10^{11}$ Ω·cm.

The intermediate transfer member 55 is provided in contact with the bottom part of the photosensitive member 51, being axially supported in parallel to the photosensitive member 51, and is rotated at the same peripheral speed as the photosensitive member 51 in the counterclockwise direction shown by an arrow.

The first-color toner image formed and held on the surface of the photosensitive member 51 is, in the course of passing through the transfer nip portion where the photosensitive member 51 and the intermediate transfer member 55 come into contact with each other, transferred intermediately sequencially to the periphery of the intermediate transfer member 55 by the aid of the electric filed formed at the transfer nip zone by a transfer bias applied to the intermediate transfer member 55.

If necessary, after the toner image has been transferred to the transfer medium, the surface of the intermediate transfer member 55 is cleaned by a cleaning means 500 which can come in contact with or separate from it. When the toner is present on the intermediate transfer member 55, the cleaning means 500 is separated from the surface of the intermediate transfer member surface so that the toner image is not disrupted.

A transfer means is provided in contact with the bottom part of the intermediate transfer member 55, being axially supported in parallel to the intermediate transfer member 55. The transfer means 57 is, e.g., a transfer roller or a transfer belt, and is rotated at the same peripheral direction as the intermediate transfer member 55 in the clockwise direction as shown by an arrow. The transfer means 57 may be so provided as to come into direct contact with the intermediate transfer member 55, or may be so disposed that a belt or the like comes into contact with the intermediate transfer member 55 and the transfer means 57 therebetween.

In the case of the transfer roller, it is constituted basically of a mandrel 57*b* at the center and a conductive elastic layer 57*a* that forms the periphery of the mandrel.

The intermediate transfer member and the transfer roller may be formed of commonly available materials. The elastic layer of the transfer roller may be made to have a volume resistivity set smaller than the volume resistivity of the elastic layer of the intermediate transfer member, whereby the voltage to be applied to the transfer roller can be lowered, good toner images can be formed on the transfer medium, and the transfer medium can be prevented from being wound around the intermediate transfer member. In particular, the elastic layer of the intermediate transfer member may preferably have a volume resistivity at least 10 times the volume resistivity of the elastic layer of the transfer roller.

The hardness of the intermediate transfer member and transfer roller is measured according to JIS K-6301. The intermediate transfer member used in the present invention may preferably be constituted of an elastic layer with hardness in the range of from 10 to 40 degrees. As for the hardness of the transfer roller, the transfer roller may preferably have an elastic layer with hardness higher than the hardness of the elastic layer of the intermediate transfer member and has a value of from 41 to 80 degrees, in order to prevent the transfer medium from being wound around the intermediate transfer member. If the hardness relationship between the intermediate transfer member and the transfer roller is reversed, a concave may be formed on the transfer roller side to tend to cause the transfer medium to wind around the intermediate transfer member.

The transfer means 57 is rotated at a speed equal to, or different from, the peripheral speed of the intermediate transfer member 55. The transfer medium 56 is conveyed between the intermediate transfer member 55 and the transfer means 57 and simultaneously a bias with a polarity reverse to that of the triboelectric charge the toner has is applied to the transfer means 57 from a transfer bias applying means, so that the toner image on the intermediate transfer member 55 is transferred to the surface side of the transfer medium 56.

The transfer roller may be made of the same material as used in the charging roller. Preferable process conditions for the transfer are as follows: a roller contact pressure of 4.9 to 49.0 N/m (5 to 500 g/cm) and a DC voltage of ±0.2 to plus-minus 10 kV.

For example, a conductive elastic layer 57*b* of the transfer roller is made of an elastic material having a volume resistivity of about $10^6$ to $10^{10}$ ΩAcm, e.g., polyurethane or an ethylene-propylene-diene type terpolymer (EPDM), with a conductive material such as carbon dispersed therein. A bias is kept applied to a mandrel 57*a* by a constant voltage power source. As for bias conditions, a voltage of from ±0.2 to plus-minus 10 kV is preferred.

Subsequently, the transfer medium 56 is transported to a fixing assembly 501 constituted basically of a heat roller provided internally with a heating element such as a halogen heater and an elastic-material pressure roller brought into contact therewith under pressure, and is passed between the heat roller and the pressure roller, thus the toner image is fixed by the aid of heat and pressure to the transfer medium. Another method may also be used in which the toner image is fixed by a heater through a film.

A one-component developing method is described below. The toner of the present invention may be applied in one-component developing systems such as a magnetic one-component developing system and a non-magnetic one-component developing system.

The magnetic one-component developing system is described with reference to FIG. 4.

Figure 4:
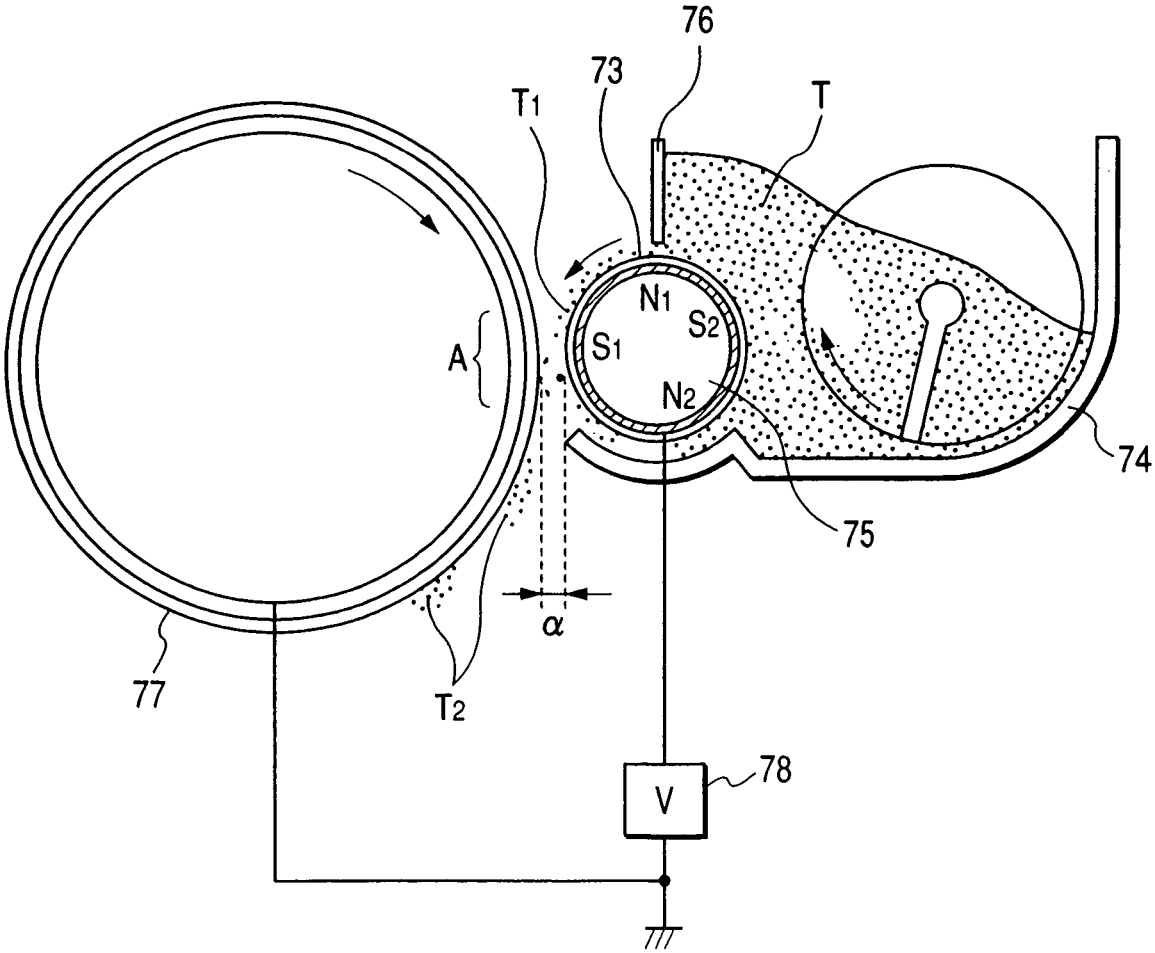
FIG. 4 is a schematic view showing an example of a developing assembly making use of a magnetic one-component developer, and its vicinity.

As shown in FIG. 4, substantially the right-half periphery of a developing sleeve 73 is always in contact with the toner stock inside a toner container 74. A toner held in the vicinity of the surface of the developing sleeve 73 is attracted to and carried on the surface of the developing sleeve by the action of magnetic force and/or electrostatic force, with the magnetic force being generated by a magnetism generating means 75 provided in the developing sleeve. The developing sleeve 73 is rotatively driven, and while the magnetic-toner layer formed on the surface of the sleeve passes through the position of a control member 76, the toner is formed into a thin-layer magnetic toner T1 with a uniform thickness at every portion. The magnetic toner is electrostatically charged chiefly by the frictional contact between the sleeve surface and the magnetic toner in a toner stock in the vicinity thereof as the developing sleeve 73 is rotated. As the developing sleeve 73 is rotated, the thin-layer surface of the magnetic toner carried on the developing sleeve 73 is rotatively moved toward the side of a latent image bearing member 77 and passes through a developing zone A at which the latent image bearing member 77 and the developing sleeve 73 come nearest. In the course of passing through the developing zone A, the magnetic toner of the magnetic toner thin layer formed on the developing sleeve 73 is attracted by the aid of DC and AC electric fields generated by direct current and alternating current voltages applied across the latent image bearing member 77 and the developing sleeve 73, and reciprocates (at a gap $\alpha$) between the surface of the latent image bearing member 77 and the surface of the developing sleeve 73 at the developing zone A. Finally, the magnetic toner on the side of the developing sleeve 73 is selectively transferred and attached to the surface of the latent image bearing member 77 in accordance with potential patterns of latent images, so that toner images T2 are successively formed.

The surface of the developing sleeve 73 which has passed through the developing zone A and selectively lost the magnetic toner, is again rotated toward the magnetic toner stock in the hopper 74, and is again supplied with the magnetic toner and the magnetic toner thin layer T1 carried on the developing sleeve 73 is transported to the developing zone A. In this way, the step of development is repeated.

The control member 76 serving as a toner thin-layer forming means used in FIG. 4 is a doctor blade such as a metallic blade or a magnetic blade, provided leaving a certain gap from the developing sleeve 73. Alternatively, in place of the doctor blade, a roller made of metal, resin or ceramic may be used. Further, as the toner thin-layer forming control member, an elastic blade or an elastic roller may also be used coming into touch with the surface of the developing sleeve (toner carrying member) by elastic force.

As materials for forming the elastic blade or elastic roller, it is possible to use rubber elastic materials such as silicone rubber, urethane rubber and NBR; synthetic resin elastic materials such as polyethylene terephthalate, or metal elastic materials such as stainless steel, steel and phosphor bronze, and composite materials thereof. The part coming into touch with the sleeve may preferably be the rubber elastic material or resin elastic material.

Figure 5:
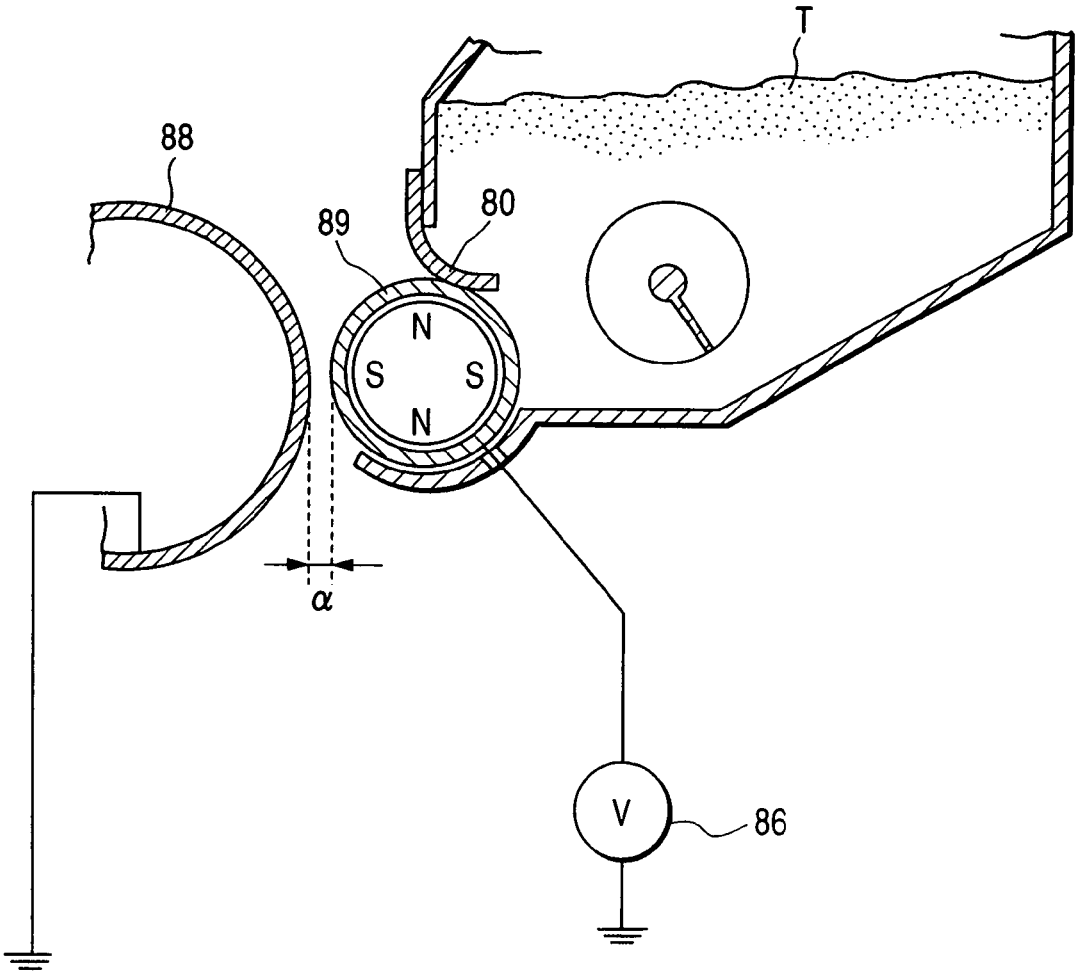
FIG. 5 is a schematic view showing an example of a developing assembly making use of a magnetic one-component developer and having an elastic blade, and its vicinity.
Figure 6:
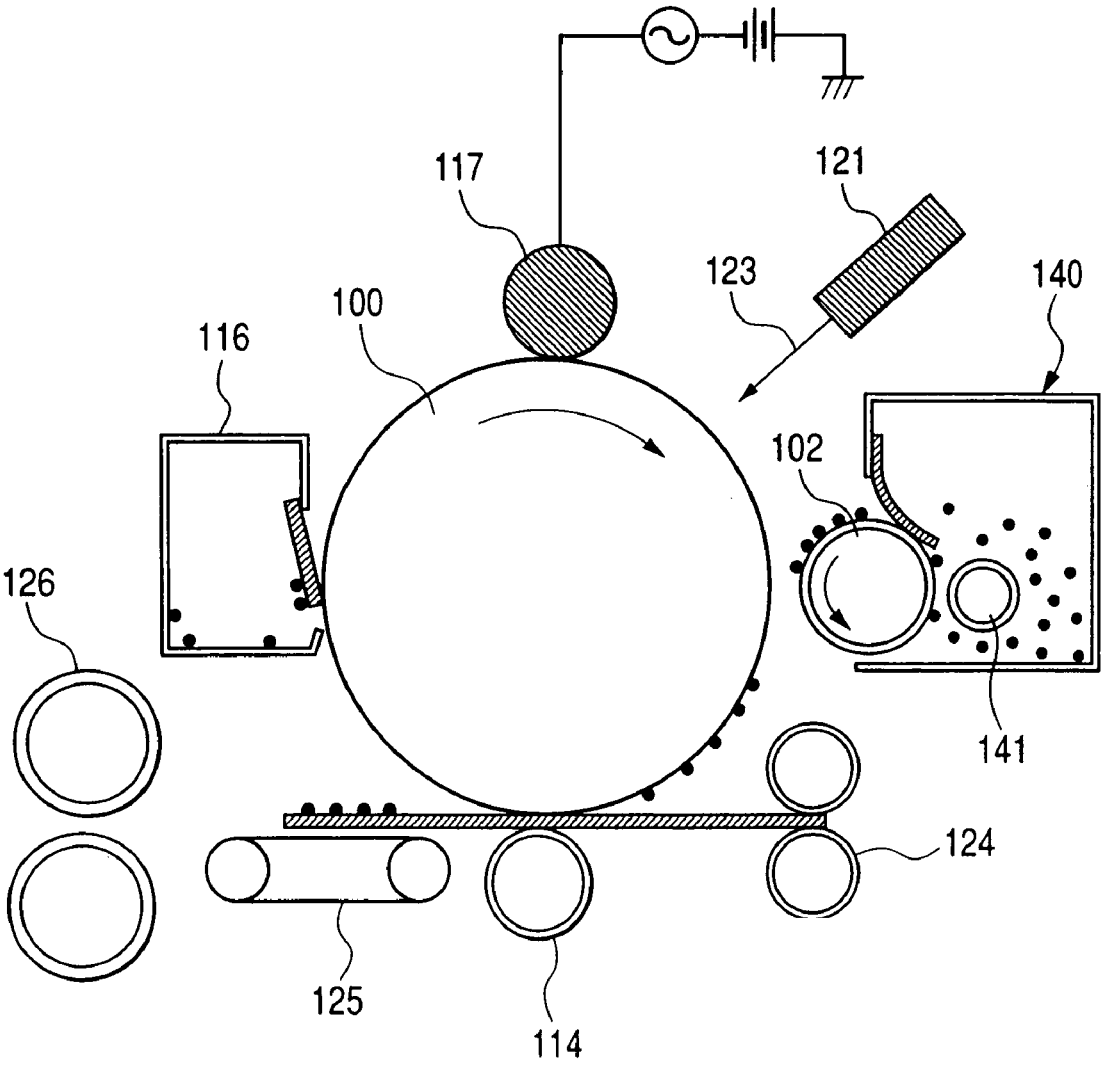
FIG. 6 is a schematic view showing an example of an image forming apparatus having a developing assembly making use of a magnetic one-component developer.

An example in which the elastic blade is used is shown in FIG. 5.

An elastic blade 80 is, at its upper side base portion, fixedly held on the side of a developer container and is so provided that the inner face side (or the outer face side in the case of the adverse direction) of the elastic blade 80 is, at its lower side, brought into touch with the surface of a developing sleeve 89 under an appropriate elastic pressure in such a state as deflected against the elasticity of the blade 80 in the forward or backward direction of the rotation of the developing sleeve 89. According to such an assemblage, a toner layer can be formed which is thin and dense, and more stable even against environmental variations.

In the case where the elastic blade is used, toner melt-adhesion to the sleeve and blade surfaces is apt to occur. However, the toner of the present invention is preferably usable because it has superior releasability and stable triboelectric chargeability.

In the case of the magnetic one-component developing system, it is preferable for the elastic blade 80 to be brought into touch with the developing sleeve 89 at a pressure of 0.98 N/m (0.1 kg/m) or more, preferably from 2.94 to 245 N/m (0.3 to 25 kg/m), and more preferably from from 4.9 to 117.6 N/m (0.5 to 12 kg/m), as a linear pressure in the generatrix direction of the sleeve. The gap a between a latent image bearing member 88 and the developing sleeve 89 may preferably be set to be, e.g., from 50 to 500 μm. It is most preferable that the layer thickness of the magnetic-toner layer formed on the developing sleeve 89 is smaller than the gap a between the latent image bearing member 88 and the developing sleeve 89. In some cases, the layer thickness of the magnetic-toner layer may be regulated in such an extent that part of a large number of ears of the magnetic toner constituting the magnetic-toner layer comes into contact with the surface of the latent image bearing member 88.

The developing sleeve 89 is rotated at a peripheral speed of from 100 to 200% with respect to the latent image bearing member 88. The alternating bias voltage applied by a voltage applying means 86 may preferably be applied at a peak-to-peak voltage of 0.1 kV or above, preferably from 0.2 to 3.0 kV, and more preferably from 0.3 to 2.0 kV. The alternating bias may be applied at a frequency of from 0.5 to 5.0 kHz, preferably from 1.0 to 3.0 kHz, and more preferably from 1.5 to 3.0 kHz. As the waveform of the alternating bias, a rectangular waveform, a sine waveform, a sawtooth waveform or a triangle waveform may be used. An asymmetrical AC bias different in forward/backward voltages and time may be used. It is also preferable to superimpose a DC bias.

Various physical properties of the toner and image evaluation methods are described below. In Examples given below, evaluation is made according to these methods.

Toner Physical Properties (1) Average Circularity and Mode Circularity of Toner Particles:

The average circularity referred to in the present invention is used as a simple method for expressing the shape of particles quantitatively. In the present invention, the shape of particles is measured with a flow type particle image analyzer FPIA-1000, manufactured by Sysmex Corporation, and the circularity (Ci) of each particle measured on a group of particles having a circle-equivalent diameter of 3 μm or more is individually determined according to the following expression (2). As shown in the following expression (3), the value obtained when the sum total of circularities of all particles measured is divided by the number (m) of all particles is defined as the average circularity (C).

The "mode circularity" refers to the lower-limit value of a division range in which the frequency value comes to the maximum in the circularity frequency distribution obtained in such a way that circularities of from 0.40 to 1.00 are divided into 61 ranges at intervals of 0.01 and the toner circularities measured are allotted to the respective division ranges in accordance with the circularities.

Expression (2)

Circularity (Ci)=(circumference of circle whose area is equal to projected particle area)/(perimeter of projected particle image)

Expression (3)

$$\text{Average circularity}(\overline{C}) = \sum_{i=1}^{m} Ci/m.$$

The measuring device "FPIA-1000" used in the present invention employs a calculation method in which, in calculating the circularity of each particle and thereafter calculating the average circularity and mode circularity, particles are divided into classes in which the circularities of 0.40 to 1.00 are divided into 61 ranges in accordance with the corresponding circularities, and the average circularity and mode circularity are calculated using the center values and frequencies of divided points. However, between the value of each of the average circularity and the mode circularity calculated by this calculation method and the value of each of the average circularity and the mode circularity calculated by the above calculation equation which directly uses the circularity of each particle, there is only a very small difference which is at a substantially negligible level. Accordingly, in the present invention, the calculation method in which the concept of the calculation equation directly using the above circularity of each particle is utilized and is partly modified may be used on account of handling data, e.g., shortening the calculation time and simplifying the operational equation for calculation.

As for a specific measuring method, in 10 ml of water in which about 0.1 mg of a surface-active agent has been dissolved, about 5 mg of the toner is dispersed to prepare dispersion. Then, the dispersion is exposed to ultrasonic waves (20 kHz, 50 W) for 5 minutes and adjusted to have a concentration of 5,000 to 20,000 particles/μl, where the measurement is made using the above analyzer to determine the average circularity of the group of particles having a circle-equivalent diameter of 3 μm or more.

The average circularity referred to in the present invention is an index showing the surface unevenness degree of toner particles. It is indicated as 1.00 when the particles are perfectly spherical. The more complicate the surface shape of toner particles is, the smaller the value of average circularity is.

In this measurement, the reason why the circularity is measured only on the group of particles having a circle-equivalent diameter of 3 μm or more is that a group of particles of external additives existing independently of toner particles are included in a large number in a group of particles with a circle-equivalent diameter of less than 3 μm, which may affect the measurement to make it impossible to accurately estimate the circularity on the group of toner particles.

(2) Measurement of Weight-average Particle Diameter of Toner Particles:

In the present Examples, the average particle diameter of the toner is determined in the following way. Coulter Multisizer (manufactured by Coulter Electronics, Inc.) is used. An interface (manufactured by Nikkaki K.K.) that outputs number distribution and volume distribution and a personal computer PC9801 (manufactured by NEC.) are connected. As an electrolytic solution, a 1% NaCl aqueous solution is prepared using first-grade sodium chloride. For example, ISOTON R-II (available from Coulter Scientific Japan Co.) may be used. As a dispersant, 0.1 to 5 ml of a surface-active agent, preferably an alkylbenzene sulfonate, is added to 100 to 150 ml of the above aqueous electrolytic solution, and 2 to 20 mg of a sample to be measured is further added. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of 2 μm or more by means of the above Coulter Multisizer, using an aperture of 100 μm as its aperture. Then, the volume-based weight-average particle diameter (D4) determined from the volume distribution and the number-based number-average particle diameter (D1) determined from the number distribution are determined. In addition, from the values of the two, the value of (D4)/(D1) is calculated and used as an index that shows the sharpness of particle size distribution. It is meant that the closer to 1.00 the value is, the sharper the particle size distribution is.

(3) Measurement of Fine Particles in Toner Particles:

The measurement of the fine particles in toner particles is made using a flow type particle image analyzer FPIA-1000, manufactured by Sysmex Corporation. Here, particles having particle diameters of 2.12 μm in number distribution are measured as the fine particles (measurement range: 0.6 μm or more).

As for a specific measuring method, in 10 ml of water in which about 0.1 mg of a surface-active agent, preferably an alkylbenzene sulfonate, has been dissolved, about 5 mg of the toner particles are dispersed to prepare dispersion. Then, the dispersion is exposed to ultrasonic waves (UH-50 Model, manufactured by SMT Co., Ltd.; frequency: 20 kHz; output: 50 W) for 5 minutes and adjusted to have a concentration of 5,000 to 20,000 particles/μl, where the measurement is made using the above FPIA-1000.

(4) Measurement of Polymerization Conversion:

The polymerization conversion is measured by the internal standard method under the following conditions, by gas chromatography using a sample obtained by adding a polymerization inhibitor to 0.1 g of suspension and dissolving this suspension in 4 ml of THF.

G.C. Conditions:

Measuring instrument: Shimadzu GC-15A (with a capillary).

Carrier gas: $N_2$; 2 kg/cm$^2$, 50 ml/min.; split: 10 m/13 s.

Column: ULBON HR-1,50 m×0.25 mm.

Heating: 50° C., retained for 5 minutes; to 100° C. at a rate of 10° C./min.; to 200° C. at a rate of 20° C./min. and retained thereat.

Amount of sample: 2 μl.

Reference substance: Toluene.

(5) Measurement of Alcohol Concentration in Aqueous Medium:

The alcohol concentration in the aqueous medium is measured by gas chromatography in the following way.

A polymerization reaction fluid (slurry) is filtered with a membrane filter (e.g., Disposable Membrane Filter 25JP020AN, available from Advantec Toyo, Co., Ltd.), and 2 μL of the filtrate is analysed by gas chromatography. Then, the alcohol concentration in the aqueous medium is measured according to a calibration curve previously prepared using the corresponding alcohol.

Analysis Conditions:

GC: HP Co., 6890GC.

Column: HP Co., INNOWax (200 μm×0.40 μm×50 m).

Carrier gas: He (constant flow mode; initial flow rate: 1.00 ml/min.; average linear velocity: 25 cm/sec.).

Oven: 50° C., retained for 10 minutes; heated to 200° C. at a rate of 10° C./minute; retained at 200° C. for 5 minutes.

INJ: 200° C., split mode.

(pressure: 32.8 psi; split flow rate: 30.0 ml/min.; total flow rate: 33.5 ml/min.)

Split ratio: 30.1:1.0

DET: 250° C. (FID)

Image Evaluation

Image evaluation and running (durability) evaluation were made in the following way.

Using an modified machine (an oil application mechanism of a fixing assembly was removed) of a commercially available digital full-color copying machine (CLC500, manufactured by CANON INC.) as shown in FIG. 2, image evaluation was made in an environment of normal temperature and normal humidity (23° C., 60% RH). Then, a horizontal-line image with a print area percentage of 1% was reproduced to conduct a 7,000-sheet intermittent-mode reproduction running test (i.e., a mode in which the developing assembly is allowed to pause for 10 seconds every time the image is reproduced on one sheet, where the deterioration of the toner is accelerated by preliminary operation of the developing assembly when driven and stopped again for each sheet). Then, the image evaluation was made. Further, the image forming apparatus and all were moved to an environment of low temperature and low humidity (15° C., 10% RH), and were left standing for 30 days in that environment, and thereafter the image evaluation was made. Then, the horizontal-line image with a print area percentage of 1% was reproduced to conduct a further 7,000-sheet intermittent-mode reproduction running test, and finally the image evaluation was made again. Also, a 7,000-sheet running test was conducted in an environment of normal temperature and normal humidity (23° C., 60% RH) and thereafter the image forming apparatus was moved into an environment of high temperature and high humidity (30° C., 80% RH), and in that environment, a like test was conducted. Evaluation items and evaluation methods are as follows:

a) Image Density:

Image density was measured with "Macbeth Reflection Densitometer" (manufactured by Macbeth Co.), as relative density with respect to an image reproduced on a white background area with a density of 0.00 of an original.

A: 1.45≦Image density.

B: 1.30≦Image density<1.45.

C: 1.15≦Image density<1.30.

D: 1.00≦Image density<1.15.

D: 1.00>Image density.

b) Fog:

Fog was measured with REFLECTOMETER MODEL TC-6DS, manufactured by Tokyo Denshoku Co., Ltd.). As filters, an amber light filter was used in the case of a cyan toner, a blue filter in the case of a yellow toner, and green filters in the cases of magenta and black toners. The fog was calculated according to the following expression.

$$\text{Fog (reflectance) (\%)}=(\text{reflectance (\%) on standard paper})-(\text{reflectance (\%) of sample non-image area})$$

A: Fog (reflectance) (%)≦2.0.

B: 1.0<Fog (reflectance) (%)≦2.0.

C: 2.0<Fog (reflectance) (%)≦3.0.

D: 3.0<Fog (reflectance) (%)≦4.0.

E: 4.0<Fog (reflectance) (%)≦5.0.

F: 5.0<Fog (reflectance).

c) Transfer Performance:

The value of Macbeth density of a Mylar tape with which the transfer residual toner on the photosensitive member after transfer of solid images was stripped off and which was then stuck onto paper was represented by C; the value of Macbeth density of a Mylar tape which was stuck onto paper holding thereon the toner standing unfixed after transfer, E; and the value of Macbeth density of a Mylar tape which was stuck onto unused paper, D; where transfer efficiency was approximately calculated according to the following expression.

$$\text{Transfer efficiency (\%)}=((E-C)/(E-D))\times 100.$$

A: 98≦Transfer efficiency (%).

B: 96≦Transfer efficiency (%)<98.

C: 94≦Transfer efficiency (%)<96.

D: 92≦Transfer efficiency (%)<94.

E: 90≦Transfer efficiency (%)<92.

F: 90>Transfer efficiency (%).

d) Charging Stability:

As to the charging stability of the toner, solid black images were reproduced on one sheet, where the maximum image density difference in the solid black image was measured and used as an index of the charging stability. In addition, the image density was measured using the method for the above a).

A: 0.05>Image density difference.

B: 0.1>Image density difference≧0.05.

C: 0.2>Image density difference≧0.1.

D: 0.2<Image density difference.

e) Resolution:

Resolution was evaluated by the reproducibility of small-diameter isolated individual dots at 600 dpi, which tend to form closed electric fields on account of latent-image electric fields and are difficult to reproduce.

A: Missing dots are 5 or less per 100 dots.

B: Missing dots are 6 to 10 per 100 dots.

C: Missing dots are 11 to 20 per 100 dots.

D: Missing dots are more than 20 per 100 dots.

EXAMPLES

The present invention is described below in greater detail by giving production examples and working examples which should not be construed to limit the present invention. In the following Examples and Comparative Examples, "part(s)" and "%" are by weight in all occurrences unless particularly noted.

Production Example of

Polar Polymer 1

Into a pressurizable reaction vessel having a reflux tube, a stirrer, a thermometer, a nitrogen feed pipe, a dropping unit and an evacuation unit, 250 parts of methanol, 150 parts of 2-butanone and 100 parts of 2-propanol as solvents and 92.5 parts of styrene, 5 parts of 2-ethylhexyl acrylate and 2.5 parts of 2-acrylamido-2-methylpropanesulfonic acid as monomers were introduced, and then heated to reflux temperature with stirring. A solution prepared by diluting 4.0 parts of a polymerization initiator t-butyl peroxy-2-ethylhexanoate with 20 parts of 2-butanone was dropwise added thereto over a period of 30 minutes, and the stirring was continued for 4 hours, and a solution prepared by diluting 0.40 part of t-butyl peroxy-2-ethylhexanoate with 20 parts of 2-butanone was further dropwise added over a period of 30 minutes, followed by stirring for further 5 hours to complete polymerization.

A polymer obtained after the polymerization solvents were removed under reduced pressure was pulverized to a size of 100 μm or less by means of a cutter mill fitted with a 150-mesh screen. The polar polymer thus obtained is designated as Polar Polymer 1.

Example 1

An aqueous dispersion medium and a polymerizable monomer composition were each prepared in the following way.

Preparation of Aqueous Dispersion Medium:

To 900 parts of ion-exchange water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as described below were heated to 60° C., and then uniformly dissolved or dispersed at 9,000 rpm by means of a TK-type homomixer (manufactured by Tokushu Kika Kogyo Co., Ltd.) to prepare a polymerizable monomer composition.

| | |
|---|---|
| Styrene | 150 parts |
| n-Butyl acrylate | 50 parts |
| Colorant (C.I. Pigment Blue 15:3) | 16 parts |
| Polar Polymer 1 | 4 parts |
| Saturated polyester resin (a polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

To this composition, 4 parts of a polymerization initiator t-butyl peroxypivalate (trade name: PERBUTYL PV, available from Nippon Oil & Fats Co., Ltd.) was added and uniformly dissolved or dispersed, and then, was introduced into the above aqueous medium in the reaction vessel. Further, tert-butyl alcohol (0.6 part) was added as an alcohol component, followed by stirring at 64° C. in an atmosphere of nitrogen and at 6,000 rpm by means of the TK-type homomixer to effect granulation.

Thereafter, the granulated product was moved into a propeller type stirrer and stirred, during which the temperature was raised to 65° C. over a period of 1 hour. Three hours after, the temperature was raised to 92° C. at a heating rate of 40° C./hr, and the reaction was carried out for 5 hours. After the polymerization was completed, the reaction mixture was cooled, and dilute hydrochloric acid was added to dissolve the dispersing agent. Then, solid-liquid separation was effected, followed by washing with water used in an amount 10 times as much as the slurry, and filtration and vacuum drying to obtain Cyan Toner Particles 1.

In addition, during the polymerization reaction, the pressure in the reaction system was controlled, or tert-butyl alcohol was added as needed, whereby the alcohol concentration in the aqueous medium was controlled to be 1,800 ppm when the polymerization conversion was 30%, and further controlled to be 7,200 ppm when the polymerization conversion was 97%.

To 100 parts of the above Cyan Toner Particles 1, 1.5 parts of silica (R972, available from Nippon Aerosil Co., Ltd.) was added and mixed by means of a Henschel mixer (manufactured by Mitsui Miike Engineering Corporation) to produce Cyan Toner 1 of the present invention.

Based on 6 parts of this cyan toner, 94 parts of an acrylic-coated ferrite carrier was blended to prepare a developer. Using an modified machine (an oil application mechanism of a fixing assembly was removed) of the commercially available digital full-color copying machine (CLC500, manufactured by CANON INC.) as shown in FIG. 2, image evaluation and running evaluation were made. Physical properties of the toner are shown in Table 1, and the evaluation results are shown in Tables 2 to 5.

Examples 2 to 4

The colorant used in Example 1 was changed for C.I. Pigment Yellow 180, C.I. Pigment Red 122 and carbon black (PRINTEX L, available from Degussa Corp.), respectively, and the procedure of Example 1 was repeated to produce Yellow Toner 2, Magenta Toner 3 and Black Toner 4.

Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be the values shown in Table 1 respectively when the polymerization conversion was 30% and when the polymerization conversion was 97%.

Example 5

(Production of Hydrophobic Iron Oxide 1)

In a ferrous sulfate aqueous solution, a sodium hydroxide solution was mixed in an equivalent weight of from 1.0 to 1.1 based on iron ions, to prepare an aqueous solution containing ferrous hydroxide.

Maintaining pH of the aqueous solution at about 9, air was blown to effect oxidation reaction at 80 to 90° C. to prepare a slurry fluid from which seed crystals were to be formed.

Subsequently, to this slurry fluid, an aqueous ferrous sulfate solution was so added as to be in an equivalent weight of from 0.9 to 1.2 based on the initial alkali content (the sodium component in the sodium hydroxide). Thereafter, pH of the slurry fluid was maintained at about 8, and oxidation reaction was carried on while air was blown. After the oxidation reaction, magnetic iron oxide particles thus formed were washed, filtered and then taken out once. Here, a water-containing sample was collected in a small quantity, and its water content was beforehand measured. Then, this water-containing sample was, without being dried, re-dispersed in another aqueous medium. Then, pH of the dispersion thus formed was adjusted to about 6, and then a silane coupling agent ($n\text{-}C_6H_{13}Si(OCH_3)_3$) was added with thorough stirring in an amount of 3.0 parts based on 100 parts by weight of magnetic iron oxide (the weight of magnetic iron oxide was calculated in terms of a value obtained by subtracting the water content from the water-containing sample) to carry out coupling treatment. The hydrophobic iron oxide particles thus formed were washed, filtered and then dried by conventional methods, followed by disintegration treatment of particles standing a little agglomerated, to produce Hydrophobic Iron Oxide 1 having an average particle diameter of 0.19 μm.

(Production of Magnetic Toner 5)

Preparation of Aqueous Dispersion Medium:

To 900 parts of ion-exchange water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as described below were heated to 60° C., and then uniformly dissolved or dispersed at 9,000 rpm by means of a TK-type homomixer (manufactured by Tokushu Kika Kogyo Co., Ltd.) to prepare a polymerizable monomer composition.

| | |
|---|---|
| Styrene | 160 parts |
| n-Butyl acrylate | 40 parts |
| Hydrophobic Iron Oxide 1 | 90 parts |
| Polar Polymer 1 | 4 parts |
| Saturated polyester resin (a polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

To this composition, 4 parts of a polymerization initiator t-butyl peroxypivalate (trade name: PERBUTYL PV, available from Nippon Oil & Fats Co., Ltd.) was added and uniformly dissolved or dispersed, and then was introduced into the above aqueous medium. Further, tert-butyl alcohol (0.6 part) was added as an alcohol component, followed by stirring at 60° C. in an atmosphere of nitrogen by means of the TK-type homomixer at 6,000 rpm to effect granulation.

Then, the granulated product was moved into a propeller type stirrer and stirred, during which the temperature was raised to 65° C. over a period of 1 hour. Three hours after, the temperature was raised to 92° C. at a heating rate of 40° C./hr, and the reaction was carried out for 5 hours. After the polymerization was completed, the reaction mixture was cooled, and dilute hydrochloric acid was added to dissolve the dispersing agent. Then, solid-liquid separation was effected, followed by washing with water used in an amount 10 times as much as the slurry, and thereafter filtration and vacuum drying to produce Magnetic Toner Particles 5.

In addition, during the polymerization reaction, the pressure in the reaction system was controlled, or tert-butyl alcohol was added as needed, whereby the alcohol concentration in the aqueous medium was controlled to be 1,900 ppm when the polymerization conversion was 30%, and further controlled to be 9,200 ppm when the polymerization conversion was 97%.

To 100 parts of the above Magnetic Toner Particles 5, 1.5 parts of silica (R972, available from Nippon Aerosil Co., Ltd.) was added and mixed by means of a Henschel mixer (manufactured by Mitsui Miike Engineering Corporation) to produce Magnetic Toner 5 of the present invention.

Using this Magnetic Toner 5 and the image forming apparatus (LBP-1760, manufactured by CANON INC.) as shown in FIG. 2, having a developing assembly making use of a magnetic one-component developer, image evaluation and running evaluation were made. Physical properties of the toner are shown in Table 1, and the evaluation results are shown in Tables 2 to 5.

Example 6

An aqueous dispersion medium and a polymerizable monomer composition were each prepared in the following way.

Preparation of Aqueous Dispersion Medium:

To 900 parts of ion-exchange water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as described below were heated to 60° C., and then uniformly dissolved or dispersed at 9,000 rpm by means of a TK-type homomixer (manufactured by Tokushu Kika Kogyo Co., Ltd.) to prepare a polymerizable monomer composition.

| | |
|---|---|
| Styrene | 150 parts |
| n-Butyl acrylate | 50 parts |
| Colorant (C.I. Pigment Blue 15:3) | 16 parts |
| Polar Polymer 1 | 4 parts |
| Saturated polyester resin (polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

To this composition, 6 parts of a polymerization initiator 2,2'-azobis(2,4-dimethylvaleronitrile) was added and uniformly dissolved or dispersed, and then was introduced into the above aqueous medium. Further, tert-amyl alcohol (0.2 part) and n-butyl alcohol (0.5 part) were added as alcohol components, followed by stirring at 64° C. in an atmosphere of nitrogen and at 6,000 rpm by means of the TK-type homomixer to effect granulation.

Then, the granulated product was moved into a propeller type stirrer and stirred, during which the temperature was raised to 65° C. over a period of 1 hour. Three hours after, the temperature was raised to 94° C. at a heating rate of 40° C./hr, and the reaction was carried out for 5 hours. After the polymerization was completed, the reaction mixture was cooled, and dilute hydrochloric acid was added to dissolve the dispersing agent. Thereafter, solid-liquid separation was effected, followed by washing with water used in an amount 10 times as much as the slurry, and filtration and vacuum drying to produce Cyan Toner Particles 6.

In addition, during the polymerization reaction, the pressure in the reaction system was controlled, or n-butyl alcohol was added as needed, whereby the alcohol concentration in the aqueous medium was controlled to be 700 ppm when the polymerization conversion was 30%, and further controlled to be 2,800 ppm when the polymerization conversion was 97%. Also, during the polymerization reaction, n-butyl alcohol was so changed as to account for 70 to 80% by weight of the alcohol components contained in the aqueous medium.

To 100 parts of the above Cyan Toner Particles 6, 1.5 parts of silica (R972, available from Nippon Aerosil Co., Ltd.) was added and mixed by means of a Henschel mixer (manufactured by Mitsui Miike Engineering Corporation) to produce Cyan Toner 6 of the present invention.

Based on 6 parts of this cyan toner, 94 parts of an acrylic-coated ferrite carrier was blended to prepare a developer. Using a modified machine (an oil application mechanism of a fixing assembly was removed) of the commercially available digital full-color copying machine (CLC500, manufactured by CANON INC.) as shown in FIG. 2, image evaluation and running evaluation were made. Physical properties of the toner are shown in Table 1, and the evaluation results are shown in Tables 2 to 5.

Example 7

The polymerization initiator in Example 1 was changed to 2,2'-azobis(2,4-dimethylvaleronitrile) and the addition amount thereof was also changed to 6 parts. Further, the polymerization reaction was carried out without raising temperature from the temperature at which granulation was carried out, and the polymerization reaction time was changed to 20 hours. Except for these, the procedure for Example 1 was repeated to produce Cyan Toner 7. Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be 1,900 ppm when the polymerization conversion was 30%, and further controlled to be 2,400 ppm when the polymerization conversion was 97%.

Example 8

The polymerization initiator in Example 1 was changed to 2,2'-azobis(2,4-dimethylvaleronitrile) and the addition amount thereof was also changed to 6 parts. Further, the temperature rise for polymerization was changed from 92° C. to 75° C. Except for these, the procedure for Example 1 was repeated to produce Cyan Toner 8. Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be 1,700 ppm when the polymerization conversion was 30%, and further controlled to be 3,200 ppm when the polymerization conversion was 97%.

Example 9

The polymerization initiator in Example 1 was changed to 2,2'-azobis(4-methoxy-2,4-dimethyllvaleronitrile) and the addition amount thereof was also changed to 6 parts, except for which the procedure for Example 1 was repeated to produce Cyan Toner 9. Physical properties of the toner are shown in Table 1, and the evaluation results are shown in Tables 2 to 5.

In addition, during the polymerization reaction, the pressure in the reaction system was controlled, or tert-butyl alcohol was added as occasion calls, whereby the alcohol concentration in the aqueous medium was controlled to be 800 ppm when the polymerization conversion was 30%, and further controlled to be 9,500 ppm when the polymerization conversion was 97%.

Example 10

The polymerization initiator in Example 1 was changed to 2,2'-azobis(2-methylpropionitrile) and the addition amount thereof was also changed to 6 parts, except for which the procedure for Example 1 was repeated to produce Cyan Toner 10. Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be 1,300 ppm when the polymerization conversion was 30%, and further controlled to be 6,800 ppm when the polymerization conversion was 97%.

Example 11

The polymerization initiator in Example 1 was changed for tert-butyl peroxyacetate (trade name: PERBUTYL A, available from Nippon Oil & Fats Co., Ltd.), except for which the procedure for Example 1 was repeated to produce Cyan Toner 11. Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be 1,500 ppm when the polymerization conversion was 30%, and further controlled to be 3,300 ppm when the polymerization conversion was 97%.

Example 12

The polymerization initiator in Example 1 was changed for tert-butyl peroxyneodecanoate (trade name: PERBUTYL ND, available from Nippon Oil & Fats Co., Ltd.), except for which the procedure for Example 1 was repeated to produce Cyan Toner 12. Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be 1,200 ppm when the polymerization conversion was 30%, and further controlled to be 5,600 ppm when the polymerization conversion was 97%.

Example 13

The polymerization initiator in Example 1 was changed to 1,1,3,3-tetramethylbutyl peroxy-2-ethylhexanoate (trade name: PEROCTA O, available from Nippon Oil & Fats Co., Ltd.) and the addition amount thereof was also changed to 6 parts, except for which the procedure for Example 1 was repeated to produce Cyan Toner 13. Physical properties of the toner are shown in Table 1, and the evaluation results are shown in Tables 2 to 5.

In addition, during the polymerization reaction, the pressure in the reaction system was controlled, or tert-butyl alcohol was added as needed, whereby the alcohol concentration in the aqueous medium was controlled to be 1,800 ppm when the polymerization conversion was 30%, and further controlled to be 3,100 ppm when the polymerization conversion was 97%.

Example 14

An aqueous dispersion medium and a polymerizable monomer composition were each prepared in the following way.

Preparation of Aqueous Dispersion Medium:

To 900 parts of ion-exchange water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as described below were heated to 60° C., and then uniformly dissolved or dispersed at 9,000 rpm by means of a TK-type homomixer (manufactured by Tokushu Kika Kogyo Co., Ltd.).

| | |
|---|---|
| Styrene | 120 parts |
| Colorant (carbon black) (PRINTEX L, available from Degussa Corp.) | 14 parts |
| Polar Polymer 1 | 8 parts |

The above materials were put into an attritor dispersion machine (manufactured by Mitsui Miike Engineering Corporation), and were further dispersed at 220 rpm for 5 hours using zirconia particles of 2 mm in diameter, to prepare Mixture A.

To the above Mixture A;

| | |
|---|---|
| Styrene | 44 parts |
| n-Ethylhexyl acrylate | 36 parts |
| Saturated polyester resin (polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

were added to prepare Mixture B.

The above Mixture B was maintained at a temperature of 65° C. in a separate container, and uniformly dissolved or dispersed by means of a TK-type homomixer (manufactured by Tokushu Kika Kogyo Co., Ltd.) at 500 rpm to prepare a polymerizable monomer composition. To this composition, 6 parts by weight of a polymerization initiator 2,2'-azobis (2,4-dimethylvaleronitrile) was uniformly dissolved or dispersed, and then, was introduced into the above aqueous medium in the reaction vessel. Further, tert-butyl alcohol (0.6 part) was added as an alcohol component, followed by stirring for 5 minutes at 65° C. under purging with $N_2$, by means of the TK-type homomixer at 10,000 rpm to effect granulation. Then, the granulated product was stirred at 65° C. for 3 hours by a paddle stirring blade, and then heated to 85° C., and further stirred for 5 hours to complete polymerization reaction.

In addition, during the polymerization reaction, the pressure in the reaction system was controlled, or tert-butyl alcohol was added as needed, whereby the alcohol concentration in the aqueous medium was controlled to be 1,700 ppm when the polymerization conversion was 30%, and further controlled to be 5,500 ppm when the polymerization conversion was 97%.

After the polymerization reaction was completed, the reaction vessel was cooled, and 10% hydrochloric acid was added to dissolve the dispersion stabilizer with stirring for 2 hours in the state of pH 2. The resultant emulsion was filtered under pressure, and was further washed with 2,000 parts or more of ion-exchange water. The cake obtained was returned to 1,000 parts of ion-exchange water, followed by addition of 10% hydrochloric acid, and then stirring for 2 hours in the state of pH 2. The resultant emulsion was filtered under pressure in the same manner as in the above, and the cake obtained was returned again to 1,000 parts of ion-exchange water. To the resultant emulsion, 100 parts of an 6% aluminum chloride aqueous solution was added to effect agglomeration, and then filtered and washed with 2,000 parts or more of ion-exchange water by the use of a pressure filter. To the cake obtained on the same filter, 3,000 parts of 90° C. hot water was added to carry out hot-water heating treatment. As a result, a block-like mass composed of particles fused together with each other was formed. This block-like mass was dried at 40° C., followed by crushing by means of a hammer mill, and the crushed product was passed through a sieve with a 1 mm mesh, further followed by fine pulverization using an impact type grinding mill which utilized jet streams, to produce Cyan Toner Particles 14.

To 100 parts of the cyan toner particles, 1.5 parts of silica (R972, available from Nippon Aerosil Co., Ltd.) was added and mixed by means of a Henschel mixer (manufactured by Mitsui Miike Engineering Corporation) to produce Cyan Toner 14. Physical properties of the toner are shown in Table 1, and the evaluation results are shown in Tables 2 to 5.

Example 15

An aqueous dispersion medium and a polymerizable monomer composition were each prepared in the following way.

Preparation of Aqueous Dispersion Medium:

To 900 parts of ion-exchanged water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as described below were also heated to 58° C., and then uniformly dissolved or dispersed at 9,000 rpm by means of a TK-type homomixer (manufactured by Tokushu Kika Kogyo Co., Ltd.) to prepare a polymerizable monomer composition.

| | |
|---|---|
| Styrene | 150 parts |
| n-Butyl acrylate | 50 parts |
| Colorant (C.I. Pigment Blue 15:3) | 16 parts |
| Polar Polymer 1 | 4 parts |
| Saturated polyester resin (polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

To this composition, 16 parts of a polymerization initiator t-butyl peroxypivalate (trade name: PERBUTYL PV, available from Nippon Oil & Fats Co., Ltd.) was added and uniformly dissolved or dispersed, and then introduced into the above aqueous medium in the reaction vessel, followed by stirring at 58° C. in an atmosphere of nitrogen and at 6,000 rpm by means of the TK-type homomixer to effect granulation.

Thereafter, the granulated product obtained was moved into a propeller type stirrer and stirred, during which the temperature was raised to 63° C. over a period of 2 hours. Three hours after, the temperature was raised to 85° C. at a heating rate of 10° C./hr, and the reaction was carried out for 5 hours. After the polymerization was completed, the reaction mixture was cooled, and dilute hydrochloric acid was added to dissolve the dispersing agent. Thereafter, solid-liquid separation was effected, followed by washing with water used in an amount 10 times as much as the slurry, and then filtration and vacuum drying to produce Cyan Toner Particles 15.

In addition, during the polymerization reaction, without particularly controlling the pressure in the reaction system or adding tert-butyl alcohol, the decomposition rate of the polymerization initiator was controlled by the above temperature control to control the amount of water-soluble tert-butyl alcohol produced by decomposition of the polymerization initiator. By this method, the alcohol concentration in the aqueous medium was controlled to be 1,600 ppm when the polymerization conversion was 30%, and further controlled to be 5,100 ppm when the polymerization conversion was 97%.

To 100 parts of the above Cyan Toner Particles 15, 1.5 parts of silica (R972, available from Nippon Aerosil Co., Ltd.) was added as an inorganic fine powder, and mixed by means of a Henschel mixer (manufactured by Mitsui Miike Engineering Corporation) to produce Cyan Toner 15 of the present invention.

Physical properties of the toner are shown in Table 1, and the evaluation results are shown in Tables 2 to 5.

Comparative Example 1

The alcohol concentration in the aqueous medium in Example 1 was controlled to be 400 ppm when the polymerization conversion was 30%, and further controlled to be 6,700 ppm when the polymerization conversion was 97%, by controlling the pressure in the reaction system or adding tert-butyl alcohol, except for which the same procedure was repeated to produce Cyan Toner 16. Physical properties of the toner are shown in Table 1, and the evaluation results are shown in Tables 2 to 5.

Comparative Example 2

The alcohol concentration in the aqueous medium in Example 1 was controlled to be 2,000 ppm when the polymerization conversion was 30%, and further controlled to be 4,300 ppm when the polymerization conversion was 97%, by controlling the pressure in the reaction system or adding tert-butyl alcohol, except for which the same procedure was repeated to produce Cyan Toner 17. Physical properties of the toner are shown in Table 1, and the evaluation results are shown in Tables 2 to 5.

Comparative Example 3

The alcohol concentration in the aqueous medium in Example 1 was controlled to be 1,200 ppm when the polymerization conversion was 30%, and further controlled to be 2,100 ppm when the polymerization conversion was 97%, by controlling the pressure in the reaction system or adding tert-butyl alcohol, except for which the same procedure was repeated to produce Cyan Toner 18. Physical properties of the toner are shown in Table 1, and the evaluation results are shown in Tables 2 to 5.

Comparative Example 4

The alcohol concentration in the aqueous medium in Example 1 was controlled to be 1,700 ppm when the polymerization conversion was 30%, and further controlled to be 11,500 ppm when the polymerization conversion was 97%, by controlling the pressure in the reaction system or adding tert-butyl alcohol, except for which the same procedure was repeated to produce Cyan Toner 19. Physical properties of the toner are shown in Table 1, and the evaluation results are shown in Tables 2 to 5.

Comparative Example 5

An aqueous dispersion medium and a polymerizable monomer composition were each prepared in the following way.

Preparation of Aqueous Dispersion Medium:

To 900 parts of ion-exchange water, 3 parts of tricalcium phosphate was added, followed by stirring at 10,000 rpm by means of a TK-type homomixer (manufactured by Tokushu Kika Kogyo Co., Ltd.) to prepare an aqueous medium.

Materials formulated as described below were also heated to 60° C., and then uniformly dissolved or dispersed at 9,000 rpm by means of a TK-type homomixer (manufactured by Tokushu Kika Kogyo Co., Ltd.) to prepare a polymerizable monomer composition.

| | |
|---|---|
| Styrene | 150 parts |
| n-Butyl acrylate | 50 parts |
| Colorant (C.I. Pigment Blue 15:3) | 16 parts |
| Polar Polymer 1 | 4 parts |
| Saturated polyester resin (polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

To this composition, 6 parts of a polymerization initiator 2,2'-azobis(2,4-dimethylvaleronitrile) was added and uniformly dissolved or dispersed, and then was introduced into the above aqueous medium in the reaction vessel. Further, n-propyl alcohol (0.6 part) was added as an alcohol component, followed by stirring at 640° C. in an atmosphere of nitrogen and at 6,000 rpm by means of the TK-type homomixer to effect granulation.

Then, the granulated product was moved into a propeller type stirrer and stirred, during which the temperature was raised to 65° C. over a period of 1 hour. Four hours after, the temperature was raised to 85° C. at a heating rate of 40° C./hr, and the reaction was carried out for 5 hours. After the polymerization was completed, the reaction mixture was cooled, and dilute hydrochloric acid was added to dissolve the dispersing agent. Thereafter, solid-liquid separation was effected, followed by washing with water used in an amount 10 times as much as the slurry, and then filtration and vacuum drying to produce Cyan Toner Particles 20.

In addition, during the polymerization reaction, the pressure in the reaction system was controlled, or n-propyl alcohol was added as needed, whereby the alcohol concentration in the aqueous medium was controlled to be 1,800 ppm when the polymerization conversion was 30%, and further controlled to be 5,600 ppm when the polymerization conversion was 97%.

To 100 parts of the above cyan toner particles, 1.5 parts of silica (R972, available from Nippon Aerosil Co., Ltd.) was added and mixed by means of a Henschel mixer (manufactured by Mitsui Miike Engineering Corporation) to produce Cyan Toner 20.

Based on 6 parts of this cyan toner, 94 parts of an acrylic-coated ferrite carrier was blended to prepare a developer. Using a modified machine (an oil application mechanism of a fixing assembly was removed) of the commercially available digital full-color copying machine (CLC500, manufactured by CANON INC.) as shown in FIG. 2, image evaluation and running evaluation were made. Physical properties of the toner are shown in Table 1, and the evaluation results are shown in Tables 2 to 5.

Comparative Example 6

An aqueous dispersion medium and a polymerizable monomer composition were each prepared in the following way.

Preparation of Aqueous Dispersion Medium:

To 900 parts of ion-exchanged water, 3 parts of tricalcium phosphate was added, followed by stirring at 9,000 rpm by means of a TK-type homomixer (manufactured by Tokushu Kika Kogyo Co., Ltd.) to prepare an aqueous medium.

Materials formulated as described below were heated to 60° C., and then uniformly dissolved or dispersed at 9,000 rpm by means of a TK-type homomixer (manufactured by Tokushu Kika Kogyo Co., Ltd.) to prepare a polymerizable monomer composition.

| | |
|---|---|
| Styrene | 150 parts |
| n-Butyl acrylate | 50 parts |
| Colorant (C.I. Pigment Blue 15:3) | 16 parts |
| Polar Polymer 1 | 4 parts |
| Saturated polyester resin (polycondensation product of propylene oxide modified bisphenol A and isophthalic acid; Tg: 65° C.; Mw: 10,000) | 20 parts |
| Stearyl stearate wax (DSC peak: 60° C.) | 30 parts |
| Divinylbenzene | 0.6 part |

To this composition, 6 parts of a polymerization initiator 2,2'-azobis(2,4-dimethylvaleronitrile) was added and uniformly dissolved or dispersed, and then introduced into the above aqueous medium in the reaction vessel. Further, n-heptanol (0.6 part) was added as an alcohol component, followed by stirring at 64° C. in an atmosphere of nitrogen and at 6,000 rpm by means of the TK-type homomixer to effect granulation.

Then, the granulated product obtained was moved into a propeller type stirrer and stirred, during which the temperature was raised to 65° C. over a period of 1 hour. Four hours after, the temperature was raised to 85° C. at a heating rate of 40° C./hr, and the reaction was carried out for 5 hours. After the polymerization was completed, the reaction mixture was cooled, and dilute hydrochloric acid was added to dissolve the dispersing agent. Thereafter, solid-liquid separation was effected, followed by washing with water used in an amount 10 times as much as the slurry, and then filtration and vacuum drying to produce Cyan Toner Particles 21.

In addition, during the polymerization reaction, the pressure in the reaction system was controlled, or n-heptanol was added as needed, whereby the alcohol concentration in the aqueous medium was controlled to be 1,600 ppm when the polymerization conversion was 30%, and further controlled to be 7,500 ppm when the polymerization conversion was 97%.

To 100 parts of the above cyan toner particles, 1.5 parts of silica (R972, available from Nippon Aerosil Co., Ltd.) was added and mixed by means of a Henschel mixer (manufactured by Mitsui Miike Engineering Corporation) to produce Cyan Toner 21.

Based on 6 parts of this cyan toner, 94 parts of an acrylic-coated ferrite carrier was blended to prepare a developer. Using a modified machine (an oil application mechanism of a fixing assembly was removed) of the commercially available digital full-color copying machine (CLC500, manufactured by CANON INC.) as shown in FIG. 2, image evaluation and running evaluation were made. Physical properties of the toner are shown in Table 1, and the evaluation results are shown in Tables 2 to 5.

This application claims priority from Japanese Patent Application No. 2004-088340 filed on Mar. 25, 2004, which is hereby incorporated by reference herein.

TABLE 1

| Toner | Polymerization initiator/ 10-hr half-life temp. | Alcohol concentration at conversion of: 30% (ppm) | 97% (ppm) | Fine particles (no. %) | Average circularity/ modal circularity of toner particles | Wt. = av. particle diam. D4 (μm) | D4/(D1) |
|---|---|---|---|---|---|---|---|
| Cyan Toner 1 | t-Butyl peroxypvr/55° C. | 1,800 | 7,200 | 3 | 0.985/1.00 | 7.5 | 1.15 |
| Yellow Toner 2 | t-Butyl peroxypvr/55° C. | 1,700 | 4,400 | 2 | 0.984/1.00 | 7.3 | 1.15 |
| Magenta Toner 3 | t-Butyl peroxypvr/55° C. | 1,750 | 5,500 | 2 | 0.983/1.00 | 7.4 | 1.16 |
| Black Toner 4 | t-Butyl peroxypvr/55° C. | 1,850 | 6,500 | 3 | 0.984/1.00 | 7.3 | 1.15 |
| Magnetic Toner 5 | t-Butyl peroxypvr/55° C. | 1,900 | 9,200 | 2 | 0.985/1.00 | 7.2 | 1.14 |
| Cyan Toner 6 | 2,2'-Azobis(DMV)/51° C. | 700 | 2,800 | 9 | 0.981/0.99 | 7.2 | 1.21 |
| Cyan Toner 7 | 2,2'-Azobis(DMV)/51° C. | 1,900 | 2,400 | 9 | 0.982/0.99 | 7.3 | 1.25 |
| Cyan Toner 8 | 2,2'-Azobis(DMV)/51° C. | 1,700 | 3,200 | 7 | 0.972/0.99 | 7.3 | 1.23 |
| Cyan Toner 9 | 2,2'-Azobis(MDMV)/30° C. | 800 | 9,500 | 5 | 0.972/0.99 | 7.4 | 1.30 |
| Cyan Toner 10 | 2,2'-Azobis(MP)/65° C. | 1,300 | 6,800 | 12 | 0.979/0.99 | 7.2 | 1.23 |
| Cyan Toner 11 | t-Butyl peroxyacetate | 1,500 | 3,300 | 12 | 0.981/0.99 | 7.4 | 1.24 |
| Cyan Toner 12 | t-Butyl peroxyndn/46° C. | 1,200 | 5,600 | 8 | 0.983/0.99 | 7.5 | 1.30 |
| Cyan Toner 13 | 1,1,3,3-TMBPEH/65° C. | 1,800 | 3,100 | 8 | 0.979/0.99 | 7.3 | 1.30 |
| Cyan Toner 14 | 2,2'-Azobis(DMV)/51° C. | 1,700 | 5,500 | 5 | 0.980/0.99 | 7.4 | 1.19 |
| Cyan Toner 15 | t-Butyl peroxypvr/55° C. | 1,600 | 5,100 | 5 | 0.980/0.99 | 7.4 | 1.21 |
| Cyan Toner 16 | t-Butyl peroxypvr/55° C. | 400 | 6,700 | 25 | 0.973/0.97 | 7.2 | 1.42 |
| Cyan Toner 17 | t-Butyl peroxypvr/55° C. | 2,200 | 4,300 | 28 | 0.974/0.97 | 7.2 | 1.44 |
| Cyan Toner 18 | t-Butyl peroxypvr/55° C. | 1,200 | 2,100 | 30 | 0.973/0.97 | 7.2 | 1.44 |
| Cyan Toner 19 | t-Butyl peroxypvr/55° C. | 1,700 | 11,500 | 27 | 0.979/1.00 | 7.4 | 1.43 |

TABLE 1-continued

| Toner | Polymerization initiator/ 10-hr half-life temp. | Alcohol concentration at conversion of: 30% (ppm) | 97% (ppm) | Fine particles (no. %) | Average circularity/ modal circularity of toner particles | Wt. = av. particle diam. D4 (μm) | D4/(D1) |
|---|---|---|---|---|---|---|---|
| Cyan Toner 20 | t-Butyl peroxypvr/55° C. | 1,800 | 5,600 | 31 | 0.981/1.00 | 7.3 | 1.41 |
| Cyan Toner 21 | t-Butyl peroxypvr/55° C. | 1,600 | 7,500 | 33 | 0.979/0.99 | 7.2 | 1.42 |

peroxypvr: peroxypivalate;
(DMV): (2,4-dimethylvaleronitrile)
(MDMV): (4-methoxy-2,4-dimethylvaleronitrile);
(MP): (2-methylpropionitrile)
peroxyndn: peroxyneodecanoate;
TMBPEH: tetramethylbutyl peroxy-2-ethylhexanoate

TABLE 2

| | In normal-temperature normal-humidity environment (initial stage) | | | | | In normal-temperature normal-humidity environment (after 7,000-sheet running) | | | | |
|---|---|---|---|---|---|---|---|---|---|---|
| | Image density | Fog | Transfer performance | Charging stability | Resolution | Image density | Fog | Transfer performance | Charging stability | Resolution |
| Example: | | | | | | | | | | |
| 1 | A | A | A | A | A | A | A | A | A | A |
| 2 | A | A | A | A | A | A | A | A | A | A |
| 3 | A | A | A | A | A | A | A | A | A | A |
| 4 | A | A | A | A | A | A | A | A | A | A |
| 5 | A | A | A | A | A | A | A | A | A | A |
| 6 | A | A | A | A | A | A | B | B | A | A |
| 7 | A | A | A | A | A | A | B | B | A | A |
| 8 | A | A | A | A | A | A | A | A | A | A |
| 9 | A | A | A | A | A | A | A | A | B | A |
| 10 | A | A | A | A | A | A | B | B | A | A |
| 11 | A | A | A | A | A | A | B | B | A | A |
| 12 | A | A | A | A | A | A | B | B | B | A |
| 13 | A | A | A | A | A | A | B | B | B | A |
| 14 | A | A | A | A | A | A | A | A | A | A |
| 15 | A | A | A | A | A | A | A | A | A | A |
| Comparative Example: | | | | | | | | | | |
| 1 | A | A | A | A | A | A | B | B | B | A |
| 2 | A | A | A | A | A | A | B | B | B | A |
| 3 | A | A | A | A | A | A | B | B | B | A |
| 4 | A | A | A | A | A | A | B | B | B | A |
| 5 | A | A | A | A | A | A | B | B | B | A |
| 6 | A | A | A | A | A | A | B | B | B | A |

TABLE 3

| | In low-temperature low-humidity environment (after leaving for 30 days) | | | | | In low-temperature low-humidity environment (after 14,000 sheets in all) | | | | |
|---|---|---|---|---|---|---|---|---|---|---|
| | Image density | Fog | Transfer performance | Charging stability | Resolution | Image density | Fog | Transfer performance | Charging stability | Resolution |
| Example: | | | | | | | | | | |
| 1 | A | A | A | A | A | A | A | A | A | A |
| 2 | A | A | A | A | A | A | A | A | A | A |
| 3 | A | A | A | A | A | A | A | A | A | A |
| 4 | A | A | A | A | A | A | A | A | A | A |
| 5 | A | A | A | A | A | A | A | A | A | A |
| 6 | A | B | B | A | A | A | B | B | A | B |
| 7 | A | B | B | A | A | A | B | B | A | B |
| 8 | A | A | A | A | A | A | A | A | A | B |
| 9 | A | A | A | B | A | A | A | A | B | B |
| 10 | A | B | B | A | A | A | B | B | A | B |
| 11 | A | B | B | A | A | A | B | B | A | B |
| 12 | A | B | B | B | A | A | B | B | B | B |
| 13 | A | B | B | B | A | A | B | B | B | B |

TABLE 3-continued

| | In low-temperature low-humidity environment (after leaving for 30 days) | | | | | In low-temperature low-humidity environment (after 14,000 sheets in all) | | | | |
|---|---|---|---|---|---|---|---|---|---|---|
| | Image density | Fog | Transfer performance | Charging stability | Resolution | Image density | Fog | Transfer performance | Charging stability | Resolution |
| 14 | A | A | A | A | A | A | A | A | A | A |
| 15 | A | A | A | A | A | A | A | A | A | A |
| Comparative Example: | | | | | | | | | | |
| 1 | A | B | B | B | A | B | C | C | C | C |
| 2 | A | B | B | B | A | B | C | C | C | C |
| 3 | A | B | B | B | A | B | C | C | C | C |
| 4 | A | B | B | B | A | B | C | C | C | C |
| 5 | A | B | B | B | A | B | C | C | C | C |
| 6 | A | B | B | B | A | B | C | C | C | C |

TABLE 4

| | In normal-temperature normal-humidity environment (initial stage) | | | | | In normal-temperature normal-humidity environment (after 7,000-sheet running) | | | | |
|---|---|---|---|---|---|---|---|---|---|---|
| | Image density | Fog | Transfer performance | Charging stability | Resolution | Image density | Fog | Transfer performance | Charging stability | Resolution |
| Example: | | | | | | | | | | |
| 1 | A | A | A | A | A | A | A | A | A | A |
| 2 | A | A | A | A | A | A | A | A | A | A |
| 3 | A | A | A | A | A | A | A | A | A | A |
| 4 | A | A | A | A | A | A | A | A | A | A |
| 5 | A | A | A | A | A | A | A | A | A | A |
| 6 | A | A | A | A | A | A | B | B | A | A |
| 7 | A | A | A | A | A | A | B | B | A | A |
| 8 | A | A | A | A | A | A | A | A | A | A |
| 9 | A | A | A | A | A | A | A | A | B | A |
| 10 | A | A | A | A | A | A | B | B | A | A |
| 11 | A | A | A | A | A | A | B | B | A | A |
| 12 | A | A | A | A | A | A | B | B | B | A |
| 13 | A | A | A | A | A | A | B | B | B | A |
| 14 | A | A | A | A | A | A | A | A | A | A |
| 15 | A | A | A | A | A | A | A | A | A | A |
| Comparative Example: | | | | | | | | | | |
| 1 | A | A | A | A | A | A | B | B | B | A |
| 2 | A | A | A | A | A | A | B | B | B | A |
| 3 | A | A | A | A | A | A | B | B | B | A |
| 4 | A | A | A | A | A | A | B | B | B | A |
| 5 | A | A | A | A | A | A | B | B | B | A |
| 6 | A | A | A | A | A | A | B | B | B | A |

TABLE 5

| | In high-temperature high-humidity environment (after leaving for 30 days) | | | | | In high-temperature high-humidity environment (after 14,000 sheets in all) | | | | |
|---|---|---|---|---|---|---|---|---|---|---|
| | Image density | Fog | Transfer performance | Charging stability | Resolution | Image density | Fog | Transfer performance | Charging stability | Resolution |
| Example: | | | | | | | | | | |
| 1 | A | A | A | A | A | A | A | A | A | A |
| 2 | A | A | A | A | A | A | A | A | A | A |
| 3 | A | A | A | A | A | A | A | A | A | A |
| 4 | A | A | A | A | A | A | A | A | A | A |
| 5 | A | A | A | A | A | A | A | A | A | A |
| 6 | A | B | B | A | A | B | B | B | A | A |
| 7 | A | B | B | A | A | B | B | B | A | A |
| 8 | A | A | A | A | A | B | A | A | A | A |
| 9 | A | A | A | B | A | B | A | A | B | A |
| 10 | A | B | B | A | A | B | B | B | A | A |
| 11 | A | B | B | A | A | B | B | B | A | A |

TABLE 5-continued

| | In high-temperature high-humidity environment (after leaving for 30 days) | | | | | In high-temperature high-humidity environment (after 14,000 sheets in all) | | | | |
|---|---|---|---|---|---|---|---|---|---|---|
| | Image density | Fog | Transfer performance | Charging stability | Resolution | Image density | Fog | Transfer performance | Charging stability | Resolution |
| 12 | A | B | B | B | A | B | B | B | B | A |
| 13 | A | B | B | B | A | B | B | B | B | A |
| 14 | A | A | A | A | A | A | A | A | A | A |
| 15 | A | A | A | A | A | A | A | A | A | A |
| Comparative Example: | | | | | | | | | | |
| 1 | A | C | C | C | A | C | C | C | C | B |
| 2 | A | C | C | C | A | C | C | C | C | B |
| 3 | A | C | C | C | A | C | C | C | C | B |
| 4 | A | C | C | C | A | C | C | C | C | B |
| 5 | A | C | C | C | A | C | C | C | C | B |
| 6 | A | C | C | C | A | C | C | C | C | B |

What is claimed is:

1. A process for producing toner particles which comprises dispersing in an aqueous medium a polymerizable monomer composition containing at least a polymerizable monomer and a colorant, and carrying out polymerization by using a polymerization initiator, wherein in the aqueous medium, alcohol having 4 to 6 carbon atoms is so adjusted as to be in a concentration of 500 ppm to 2,000 ppm when a polymerization conversion of the polymerizable monomer composition is 30%, and to be from 2,300 ppm to 10,000 ppm when a polymerization conversion of the polymerizable monomer composition is 97%.

2. The process for producing toner particles according to claim 1, wherein alcohol having 4 carbon atoms accounts for 90% by weight to 100% by weight of alcohol components contained in the aqueous medium.

3. The process for producing toner particles according to claim 2, wherein alcohol having 4 carbon atoms is tert-butyl alcohol.

4. The process for producing toner particles according to claim 1, wherein after the polymerization conversion reaches 30% and before reaching 97% polymerization reaction temperature is raised.

5. The process for producing toner particles according to claim 1, wherein before the polymerization conversion reaches 30%, polymerization is carried out at a temperature not higher than the azeotropic point of the aqueous medium and alcohol having 4 carbon atoms, and after the polymerization conversion reaches 30% and before reaching 97%, polymerization is carried out at a temperature not lower than the azeotropic point of the aqueous medium and alcohol having 4 carbon atoms.

6. The process for producing toner particles according to claim 1, wherein the polymerization initiator has a 10-hour half-life period temperature of from 40° C. or more to less than 60° C.

7. The process for producing toner particles according to claim 1, wherein the polymerization initiator is a compound having a structure represented by the following Formula (1):

Formula (1)

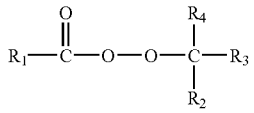

wherein $R_1$ is a functional group selected from the group consisting of a substituted or unsubstituted alkyl group having 3 to 8 carbon atoms, a substituted or unsubstituted cycloalkyl group having 3 to 8 carbon atoms and a substituted or unsubstituted aryl group having 3 to 8 carbon atoms; and $R_2$, $R_3$ and $R_4$ are each independently a substituted or unsubstituted alkyl group provided that a total number of carbon atoms of $R_2$, $R_3$ and $R_4$ is 3 to 5.

8. The process for producing toner particles according to claim 1, wherein the toner particles are produced by dispersing the polymerizable monomer composition in the aqueous medium to effect granulation, and carrying out suspension polymerization by using the polymerization initiator.

* * * * *